US007389071B2

(12) United States Patent
Katsuyama et al.

(10) Patent No.: US 7,389,071 B2
(45) Date of Patent: Jun. 17, 2008

(54) APPARATUSES FOR IMAGE FORMING CAPABLE OF EFFECTIVELY CONVEYING DEVELOPER THEREFROM AND A METHOD OF EFFECTIVELY FORMING A REINFORCING MEMBER ADHERING TO THE APPARATUSES

(75) Inventors: Goro Katsuyama, Yokohama (JP); Keisuke Katoh, Numazu (JP); Emi Kita, Tokyo (JP); Nobuo Takami, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 288 days.

(21) Appl. No.: 11/113,174

(22) Filed: Apr. 25, 2005

(65) Prior Publication Data

US 2006/0002743 A1 Jan. 5, 2006

(30) Foreign Application Priority Data

Apr. 23, 2004 (JP) ..... 2004-127537
Dec. 28, 2004 (JP) ..... 2004-378907

(51) Int. Cl.
*G03G 15/08* (2006.01)

(52) U.S. Cl. ..... 399/258; 399/260

(58) Field of Classification Search ..... 399/107, 399/119, 120, 252, 254, 258, 259, 260, 262; 222/DIG. 1
See application file for complete search history.

(56) References Cited

U.S. PATENT DOCUMENTS 5,802,431 A * 9/1998 Nagashima et al. ..... 399/262
6,151,938 A 11/2000 Park et al.
6,304,739 B1 10/2001 Katsuyama et al.
6,507,720 B2 1/2003 Kabumoto et al.
6,519,436 B2 2/2003 Katsuyama
6,532,352 B2 3/2003 Katsuyama
6,549,744 B2 4/2003 Terazawa et al.
6,628,915 B2 9/2003 Muramatsu et al.
6,641,770 B2 11/2003 Schieberl
6,647,236 B2 11/2003 Katsuyama
6,648,218 B2 11/2003 Katsuyama et al.
6,690,901 B2 2/2004 Katsuyama et al.
6,771,921 B2 8/2004 Katsuyama
6,782,234 B2 8/2004 Takami
6,785,496 B2 8/2004 Iwata et al.
6,819,897 B2 11/2004 Kita
6,871,034 B2 3/2005 Muramatsu et al.

(Continued)

FOREIGN PATENT DOCUMENTS

EP 0 839 625 A2 5/1998

(Continued)

OTHER PUBLICATIONS

U.S. Appl. No. 11/722,614, filed Jun. 22, 2007, Katoh.

*Primary Examiner*—Hoan Tran
(74) *Attorney, Agent, or Firm*—Oblon, Spivak, McClelland, Maier & Neustadt, P.C.

(57) ABSTRACT

A developer container includes a cap controlling a flow of developer with a hole, the cap detachably engaged with a nozzle connecting to an image forming apparatus, and a developer case containing the developer with an outlet be connected to the hole. The developer case allows the developer to flow through the outlet in a direction different from the flow of developer through the hole.

57 Claims, 20 Drawing Sheets

U.S. PATENT DOCUMENTS

| | | | | |
|---|---|---|---|---|
| 6,882,817 | B2 | 4/2005 | Kita | |
| 7,085,522 | B2 | 8/2006 | Muramatsu et al. | |
| 7,116,928 | B2 * | 10/2006 | Muramatsu et al. | 399/258 |
| 7,184,691 | B2 * | 2/2007 | Kita et al. | 399/119 |
| 7,209,689 | B2 * | 4/2007 | Matsumoto et al. | 399/262 |
| 2003/0012586 | A1 | 1/2003 | Iwata et al. | |
| 2004/0114958 | A1 | 7/2004 | Katsuyama et al. | |
| 2004/0131390 | A1 | 7/2004 | Kita | |
| 2004/0131392 | A1 | 7/2004 | Matsumoto et al. | |
| 2006/0002743 | A1 | 1/2006 | Katsuyama et al. | |
| 2007/0077098 | A1 | 4/2007 | Katsuyama et al. | |
| 2007/0092303 | A1 | 4/2007 | Katsuyama et al. | |
| 2007/0242984 | A1 | 10/2007 | Takami | |

FOREIGN PATENT DOCUMENTS

| | | | |
|---|---|---|---|
| EP | 1 229 402 | A2 | 8/2002 |
| EP | 1 400 869 | A1 | 3/2004 |
| GB | 1 352 429 | | 5/1974 |
| JP | 2001-324863 | | 11/2001 |
| JP | 2003-043797 | | 2/2003 |
| JP | 2004-333705 | | 11/2004 |
| WO | WO 2004/027522 | A1 | 4/2004 |

* cited by examiner

APPARATUSES FOR IMAGE FORMING CAPABLE OF EFFECTIVELY CONVEYING DEVELOPER THEREFROM AND A METHOD OF EFFECTIVELY FORMING A REINFORCING MEMBER ADHERING TO THE APPARATUSES

CROSS-REFERENCE TO RELATED APPLICATIONS

The present patent application claims priority under 35 U.S.C. § 119 to Japanese patent applications No. 2004-127537 filed on Apr. 23, 2004, and No. 2004-378907 filed on Dec. 28, 2004 in the Japanese Patent Office, the entire contents of each of which are hereby incorporated herein by reference.

BACKGROUND OF THE INVENTION

1. Field of the Invention

The following disclosure relates to a developer container used for image forming, an image forming apparatus including the developer container and a method of forming a reinforcing member adhering to the developer container.

2. Description of the Background Art

The use of replaceable developer containers has widely been known to replenish developer consumed in a developing process of electrophotographic image forming. Such replaceable developer containers are replaced with a new or fully packed developer container whenever developer contained therein becomes short or is exhausted. Additionally, for environmental conservation, recycling of developer containers is highly desired.

In one technique, a developer container includes a flexible material so that the developer container can be compactly folded when developer in the developer container is fully consumed. This reduces a volume of the developer container, thereby reducing transportation cost in recycling. The developer container in the above-described technique is connected to a nozzle of an image forming apparatus with an opening of the developer container facing down to form a developer conveying mechanism. When the developer container and the nozzle are connected so as to not change a direction of a flow of developer, a total length of the developer conveying mechanism may be rather high. When the nozzle is designed to change the flow of developer so that, for example, developer can flow vertically in the developer container and horizontally in the nozzle, the developer conveying mechanism may still need a certain height. In this case, the image forming apparatus also needs a space that can accommodate the height of the developer container and the nozzle. Therefore, the above-described developer container creates size limitations for itself and the image forming apparatus.

In another technique, a developer container includes a guide member partly with fold parts so that the developer container can be compactly folded when developer in the developer container is exhausted. Further, the developer container having the guide member can promote the deformation of the developer container. Since the guide member is formed of material whose rigidity is higher than the developer container, when the developer container is deformed because of the reduction of the volume, the fold part of the guide member pushes the fold of the container. Also, the inner wall surface of the guide member uniformly pushes the plane part of the developer container. This reduces a volume of the developer container, thereby reducing transportation cost in recycling, as in the aforementioned technique.

However, the above-described techniques may still cause developer suction failure.

Referring to FIG. 1, a schematic structure of a background developer container 500 is described.

The background developer container 500 generally includes a bag-like developer case 501 packed with developer, a cap 502 connected to the bag-like developer case 501, and reinforcing members 503 attached to flat surfaces oppositely disposed to face to each other. The reinforcing members 503 provide higher rigidity to the flat surfaces than the other surfaces having folds F of the bag-like developer case 501. The cap 502 includes a nozzle-receiving hole 504 into which a cylindrical shutter member 505 is inserted.

Referring to FIG. 2A, a schematic structure of a developer conveying mechanism including the background developer container 500 is described.

The developer conveying mechanism includes the background developer container 500, a pump unit 600, and a developing unit 700.

In FIG. 2A, the background developer container 500 of FIG. 1 is connected to a nozzle 507 at the cap 502. Developer from developer container 500 is communicated to the developing unit 700 via a developer conveying tube 508. The developer conveying tube 508 is connected to the nozzle 507 at one end and to the pump unit 600 at the other end.

The pump unit 600 delivers developer stored in the developer container 500 to the developing unit 700 by creating suction through the developer conveying tube 508.

The developing unit 700 develops a toner image formed on an image bearing member provided in an image forming apparatus.

As previously described, developer contained in the developer container 500 is supplied to the developing unit 700 by suction created by the pump unit 600 according to consumption of developer. In a case in which the reinforcing members 503 are formed to have a flat shape or a concave shape with respect to the respective flat surfaces of the background developer container 500, as the developer is constantly consumed, the developer container 500 may be deformed as shown in FIG. 2A. FIG. 2B shows a deformed shape of the background developer container 500, viewed from A. That is, when most of the developer is already conveyed out from the developer container 500, the developer container 500 may have portions indicated by B and C. The flat surfaces with the respective reinforcing members 503 attached thereon are in close contact with each other or are hermetically closed at the portion B, while developer remains at the portion C. This could cause a developer suction failure, followed by a developer conveying failure. That is, if the pump unit 600 mostly sucks air, an amount of developer to be conveyed per unit of time may intermittently fall below a desired amount of developer to be conveyed, which may eventually stop a flow of developer to be discharged out from the developer container 500 and leave some developer unused.

SUMMARY OF THE INVENTION

Accordingly, one object of the present invention is to eliminate the above-described drawbacks.

Another object of the present invention is to provide a novel developer container capable of effectively conveying developer therefrom.

Another object of the present invention is to provide a novel method of effectively forming a reinforcing member attached to the novel developer container.

Another object of the present invention is to provide a novel image forming apparatus including the novel developer container.

In one embodiment, a novel developer container includes a cap and a developer case. The cap is configured to control a flow of developer and includes a hole configured to be detachably engaged with a nozzle connected to an image forming apparatus. The developer case is configured to contain the developer and includes an outlet configured to be connected to the hole. The developer case allows the developer to flow through the outlet in a direction different from the flow of developer through the hole.

The developer case may include a bag including a flexibly foldable material and having at least one sheet member attached on a surface thereof. The bag is configured to decrease in volume when an inner pressure thereof decreases. The at least one sheet member may have a laterally bow-shaped surface extending outwardly from the surface of the bag, and may be configured to reinforce the surface of the bag.

The at least one sheet member may be attached to the surface such that a center portion of the at least one sheet member extends outwardly from the surface of the bag more than an edge portion of the at least one sheet member.

The bag may have first surfaces with a fold and second surfaces without a fold. The second surfaces may be disposed facing each other. The at least one sheet member may be adhered to one of the second surfaces.

The at least one sheet member may include a gripper.

The gripper may include a plurality of through holes formed in the at least one sheet member.

The plurality of through holes formed in the sheet member may be arranged to form an arc.

The plurality of through holes may have at least one rounded corner on a surface of the sheet member opposite to the surface of the developer container.

The developer case may further include an adaptor adhered to the opening of the bag and having a portion engaging with the outlet of the developer case and configured to connect the developer case and the cap.

The cap may be detachably attached to the outlet of the adaptor.

The novel developer container may further include a sealing member configured to hermetically seal a portion between the cap and the outlet of the adaptor.

The sealing member may include a packing disposed at a funnel portion of the cap.

The packing may include an O-ring.

The adaptor and the cap may be formed as a single developer conveying member.

The developer case may include a bottle having a portion engaged with the outlet of the developer case. The bottle may include an air inlet arranged at a portion different from a portion to which the outlet is engaged and including a filter configured to prevent developer from passing through the air inlet.

The bottle may include a tapered portion in which a lateral cross sectional area thereof decreases toward the outlet.

The cap may be detachably attached to the outlet of the bottle.

The novel developer container may further include a sealing member configured to hermetically seal a portion between the cap and the outlet of the bottle.

The sealing member may include a foamed polyurethane.

The sealing member may be disposed at a portion of at least one of the cap and the outlet of the bottle.

The bottle and the cap may be formed as a single developer conveying member.

The developer case may allow the developer to flow through the outlet in a direction perpendicular to the flow of developer through the hole.

The developer case may contain toner.

The developer case may further contain a carrier.

Further, in one embodiment, a novel method of forming a reinforcing member includes installing an instrument configured to form the curved sheet member, preparing an original sheet material for processing with the instrument, and processing the original sheet material to form the reinforcing member from the curved sheet member.

Preparing may include applying an adhesive on a first surface of the original sheet material, and processing may include forming a plurality of perforations in the original sheet material from a second surface of the original sheet material opposite to the first surface, and cutting out a plurality of sheet members from the second surface.

Forming may be performed from the second surface, and cutting may be performed from the first surface.

Forming and cutting may be simultaneously performed.

The instrument may include a die including a convex portion, and a tool including a concave portion.

Preparing may provide a soft original sheet material, and processing may further include rounding each corner of the plurality of the perforations.

The instrument may include a fixed injection mold having a first temperature, and a movable injection mold having a second temperature lower than the first temperature of the fixed injection mold, preparing may provide a resin material, and processing may include injecting the resin material into a gap formed between the fixed injection mold and the movable injection mold.

A surface of the resin material facing the fixed injection mold may extend outwardly to form a bowed curve.

Processing may include irradiating a surface of the original sheet material with an ultraviolet lamp.

The surface of the original sheet material irradiated by the ultraviolet lamp may extend outwardly to form a bowed curve.

Further, in one embodiment, a novel image forming apparatus includes a developing unit and a developer container having a cap and a developer case. The developing unit is configured to develop a toner image. The cap of the developer container is configured to control a flow of developer and includes a hole configured to be detachably engaged with a nozzle connected to the image forming apparatus. The developer case of the developer container is configured to contain the developer and comprises an outlet configured to be connected to the hole. The developer case allows the developer to flow through the outlet in a direction different from the flow of developer through the hole.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
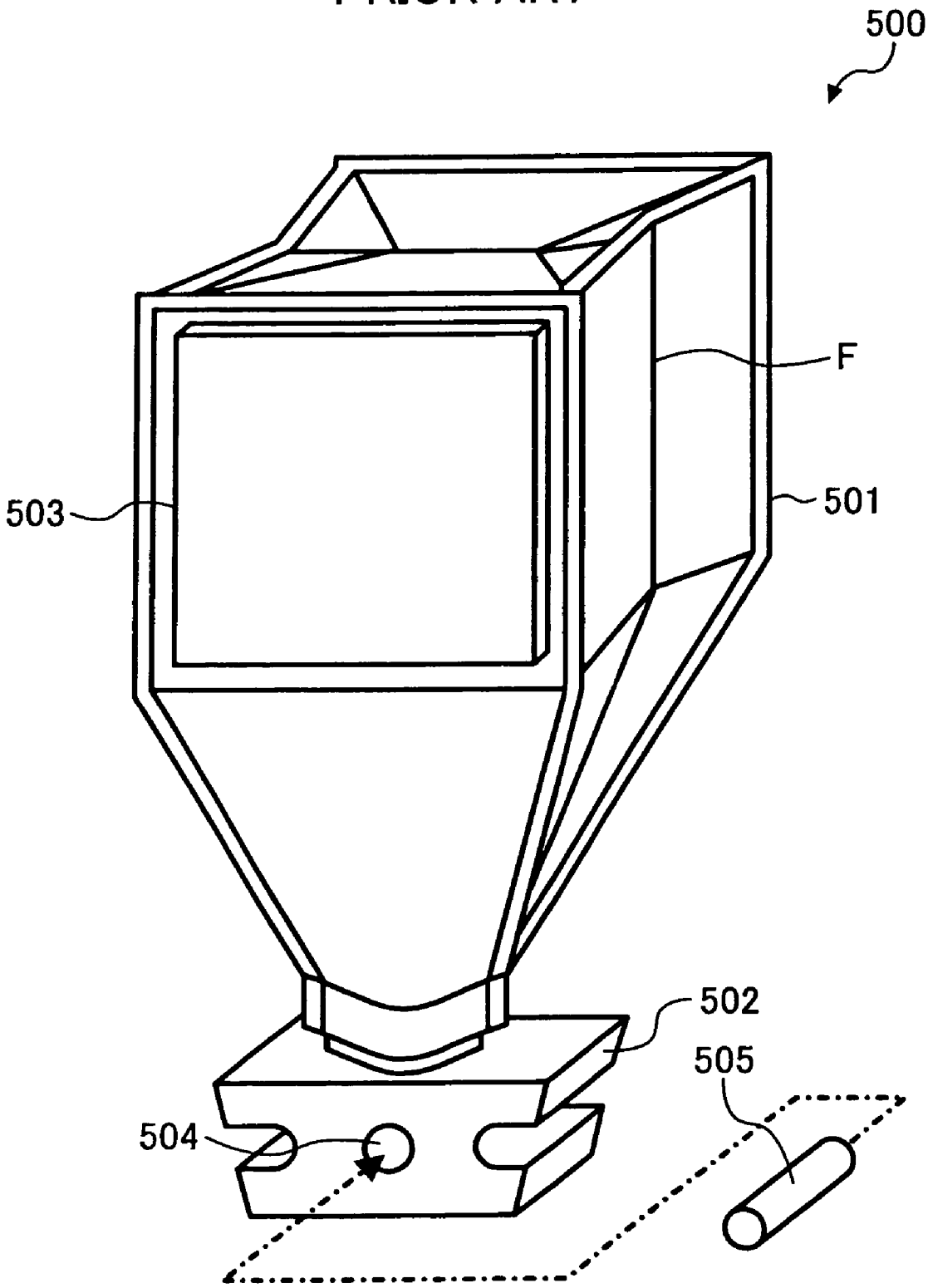
FIG. 1 PRIOR ART
FIG. 1 is a schematic structure of a background developer container.
Figure 2A:
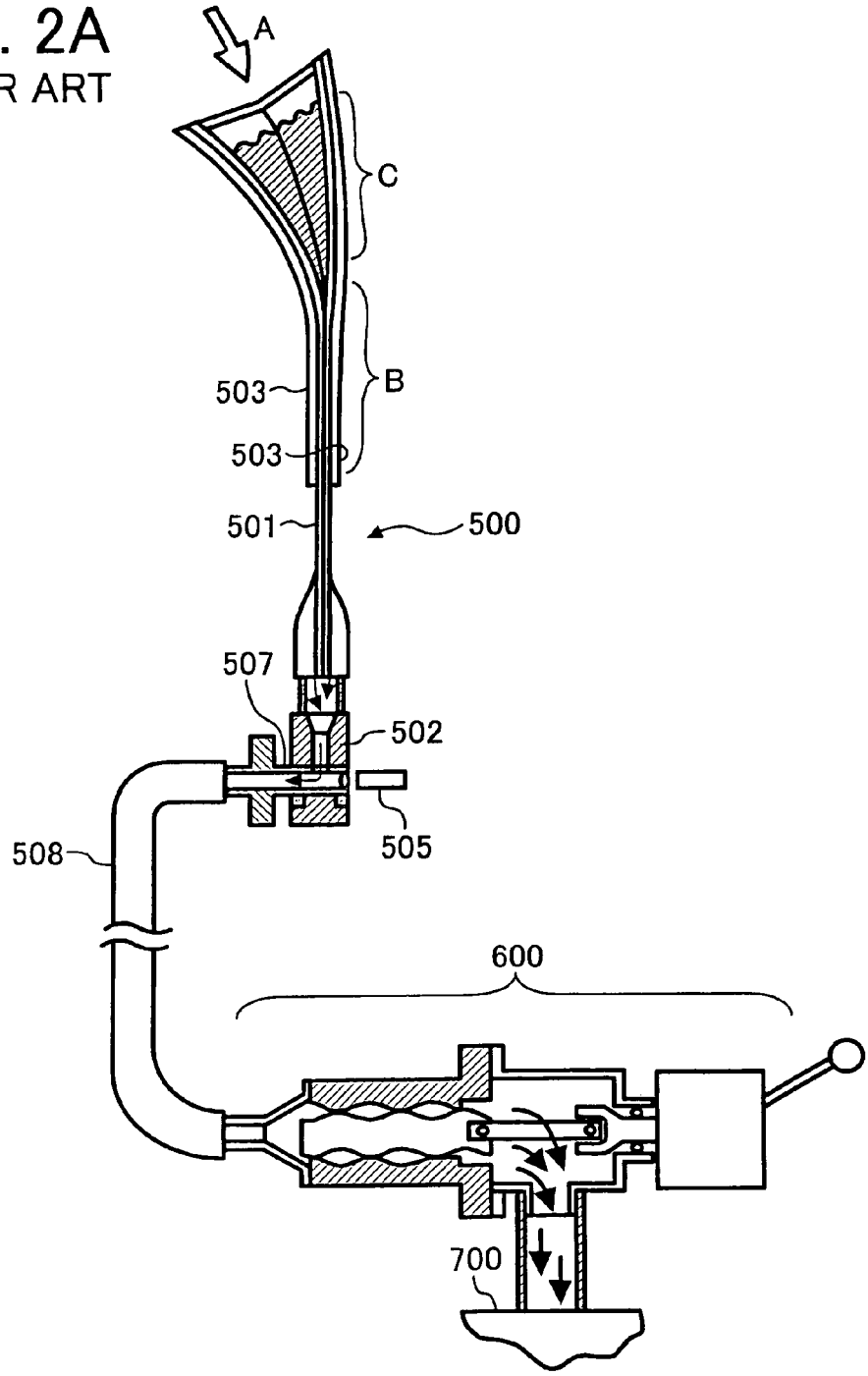
FIG. 2A PRIOR ART
FIG. 2A is a schematic structure of a background developer conveying mechanism using the background developer container of FIG. 1.
Figure 2B:
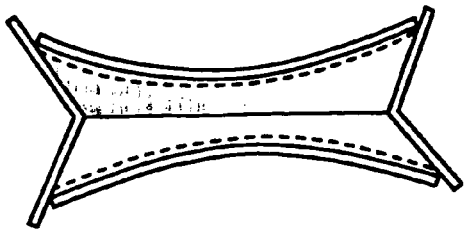
FIG. 2B PRIOR ART
FIG. 2B is a top view of the background developer container of FIG. 2A, viewed from A.

In describing embodiments of the present invention illustrated in the drawings, specific terminology is employed for clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, exemplary embodiments of the present invention are described.

Figure 3:
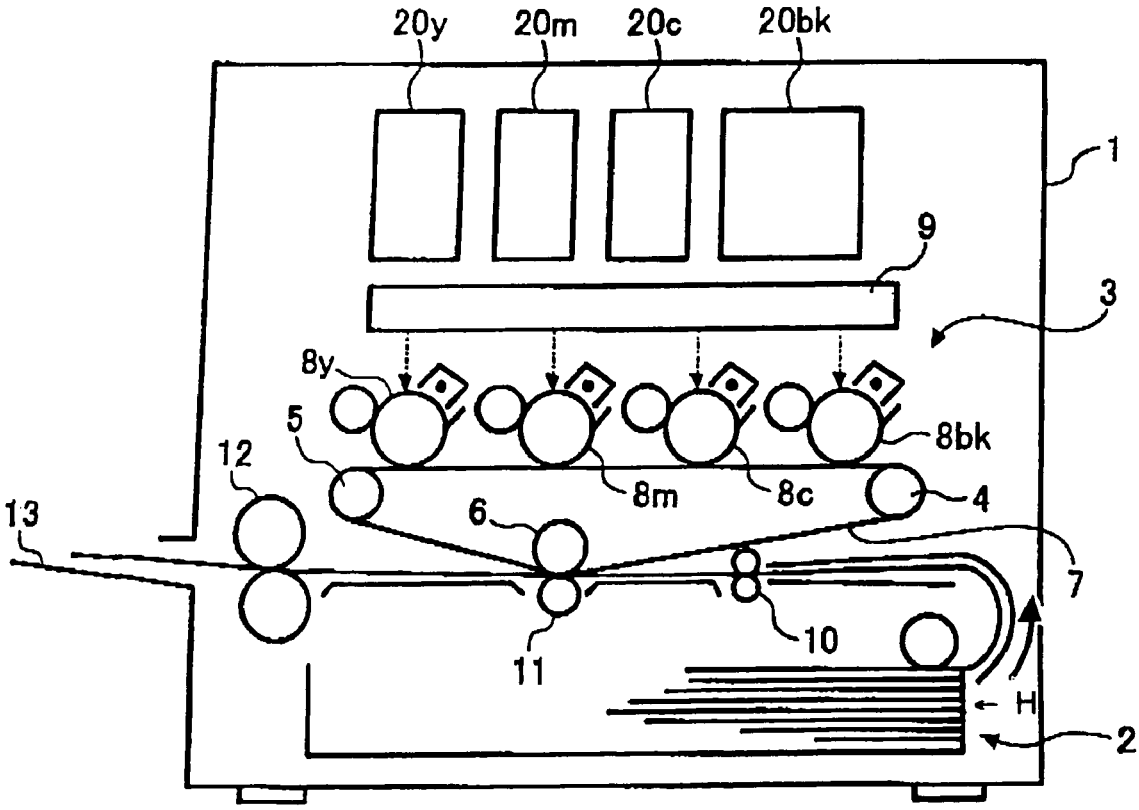
FIG. 3 is a general structure of a color laser printer in one embodiment of the present invention.

Referring to FIG. 3, a schematic structure of a color laser printer 1 serving as an image forming apparatus in one exemplary embodiment of the present invention is described. Although the color laser printer 1 of FIG. 3 is configured to form a color image with toners of four different colors, such as magenta (m), cyan (c), yellow (y) and black (bk), the image forming apparatus can be a monochromatic printer, a copier, a facsimile machine or another type of image forming apparatus.

The color laser printer 1 includes a sheet feeding mechanism 2, an image forming mechanism 3, an intermediate transfer belt 7, an optical writing unit 9, a pair of registration rollers 10, a secondary transfer bias roller 11, a fixing unit 12, a sheet discharging tray 13, and four developer containers 20*y*, 20*m*, 20*c*, and 20*bk*.

The image forming mechanism 3 includes four photoconductive drums 8*y*, 8*m*, 8*c*, and 8*bk*. Each of the four photoconductive drums 8*y*, 8*m*, 8*c*, and 8*bk* is surrounded by image forming components such as a charging unit (not shown), a developing unit (not shown in FIG. 3, see FIG. 4 for details), a cleaning unit (not shown), and a discharging unit (not shown).

The four photoconductive drums 8*y*, 8*m*, 8*c*, and 8*bk* can have similar structures and functions, except that the toners are different colors, to form magenta images, cyan images, yellow images and black images, respectively. The four photoconductive drums 8*y*, 8*m*, 8*c*, and 8*bk* are separately detachable from the color laser printer 1. The four photoconductive drums 8*y*, 8*m*, 8*c*, and 8*bk* separately receive respective light beams emitted by the writing unit 9, such that electrostatic latent images are formed on the surfaces of the four photoconductive drums 8*y*, 8*m*, 8*c* and 8*bk*.

The developing unit develops the electrostatic latent image formed on each respective photoconductive drum into a toner image. Detailed description of this process will be provided later.

The intermediate transfer belt 7 is a transport mechanism forming an endless belt and is passed over or surrounds a plurality of supporting rollers 4, 5, and 6. The intermediate transfer belt 7 is driven to rotate clockwise in FIG. 3. An upper surface area of the intermediate transfer belt 7 supported between the supporting rollers 4 and 5 is tensioned in a horizontal direction and is held in contact with the photoconductive drums 8*y*, 8*m*, 8*c*, and 8*bk*. The supporting roller 6 is arranged to face the secondary transfer bias roller 11. Four primary transfer rollers (not shown) are disposed inside a loop of the intermediate transfer belt 7 to face the respective photoconductive drums 8*y*, 8*m*, 8*c*, and 8*bk*, sandwiching the intermediate transfer belt 7.

The optical writing unit 9 reads image data output from an external computer (not shown). The optical writing unit 9 also controls light beams to form respective electrostatic latent images on respective surfaces of the photoconductive drums 8*y*, 8*m*, 8*c*, and 8*bk*, which are previously charged by the respective charging units.

The sheet feeding mechanism 2 is provided at a lower portion of the color laser printer 1 in FIG. 3. The sheet feeding mechanism 2 handles a sheet feeding operation. The sheet feeding mechanism 2 includes a sheet feeding cassette (not shown) and a sheet feeding roller (not shown). The sheet feeding cassette accommodates a plurality of recording media such as transfer sheets.

The pair of registration rollers 10 controls the intervals at which a color image is transferred onto the recording medium. The secondary transfer bias roller 11 is, as previously described, disposed in contact with the intermediate transfer belt 7 to face the supporting roller 6 sandwiching the intermediate transfer belt 7.

The fixing unit 12 is positioned at a lower left side of the color laser printer 1 of FIG. 3.

The sheet discharging tray 13 is disposed outside the body of the color laser printer 1, in the vicinity of the fixing unit 12.

The four developer containers 20*y*, 20*m*, 20*c*, and 20*bk* are disposed above the optical writing unit 9. The four developer containers 20*y*, 20*m*, 20*c*, and 20*bk* are separately detachable from the color laser printer 1. The four developer containers 20*y*, 20*m*, 20*c*, and 20*bk* serve as a developer conveying mechanism connected with the respective developing units via respective pump units (not shown in FIG. 3, see FIG. 4 for details).

Operations of the above-described color laser printer 1 are now described.

The above-described color laser printer 1 receives image data from the external computer. When the color laser printer 1 receives the image data, each of the photoconductive drums 8*y*, 8*m*, 8*c*, and 8*bk* rotates in a clockwise direction in FIG. 3 and is uniformly charged by the corresponding charging units. The optical writing unit 9 irradiates the photoconductive drums 8*y*, 8*m*, 8*c*, and 8*bk* of the image forming mechanism 3 with the light beams corresponding to the respective image data. This results in the formation of electrostatic latent images, which correspond to the respective image data, on respective surfaces of the photoconductive drums 8*y*, 8*m*, 8*c*, and 8*bk*. The electrostatic latent images formed on the respective photoconductive drums 8*y*, 8*m*, 8*c*, and 8*bk* are developed by the respective developers, including respective color toners of the developer containers 20*y*, 20*m*, 20*c*, and 20*bk* of the respective developing units. The respective color toners are conveyed by respective developer conveying mechanisms to form magenta, cyan, yellow and black toner images, which will be referred to as respective color toner images, on the respective photoconductive drums 8*y*, 8*m*, 8*c*, and 8*bk*.

The respective color toner images formed on the respective photoconductive drums 8*y*, 8*m*, 8*c*, and 8*bk* are then sequentially transferred onto the intermediate transfer belt 7, resulting in the formation of an overlaid full color image.

After the respective toner images are transferred to the intermediate transfer belt 7, residual toner on the respective surfaces of the photoconductive drums 8*y*, 8*m*, 8*c*, and 8*bk* are removed by the respective cleaning units. The residual toner is discharged by the respective discharging units.

A recording medium is fed from one of the sheet feeding cassettes of the sheet feeding mechanism 2. When the sheet feeding roller is rotated by a drive motor (not shown), a recording medium placed on the top of a stack of transfer sheets in the sheet feeding cassette is fed and conveyed in a direction indicated by arrow H in FIG. 3. The recording medium is conveyed to a portion between the pair of registration rollers 10. The recording medium is fed to the image forming mechanism 3 in synchronization with the pair of registration rollers 10 so that the full color image formed on the intermediate transfer belt 7 is transferred onto a proper position of the recording medium. Accordingly, the recording medium is fed and the full color image is transferred from the intermediate transfer belt 7 onto the recording medium.

The full color toner image on the recording medium is fixed by the fixing unit 12 through the application of heat and pressure. The recording medium having the fixed full color image is fed through a predetermined passage depending on image forming instructions, and is discharged to the sheet discharging tray 13.

After the full color image is transferred to the recording medium, residual toner on the intermediate transfer belt 7 is removed and collected by an intermediate transfer belt cleaning unit (not shown).

Figure 4:
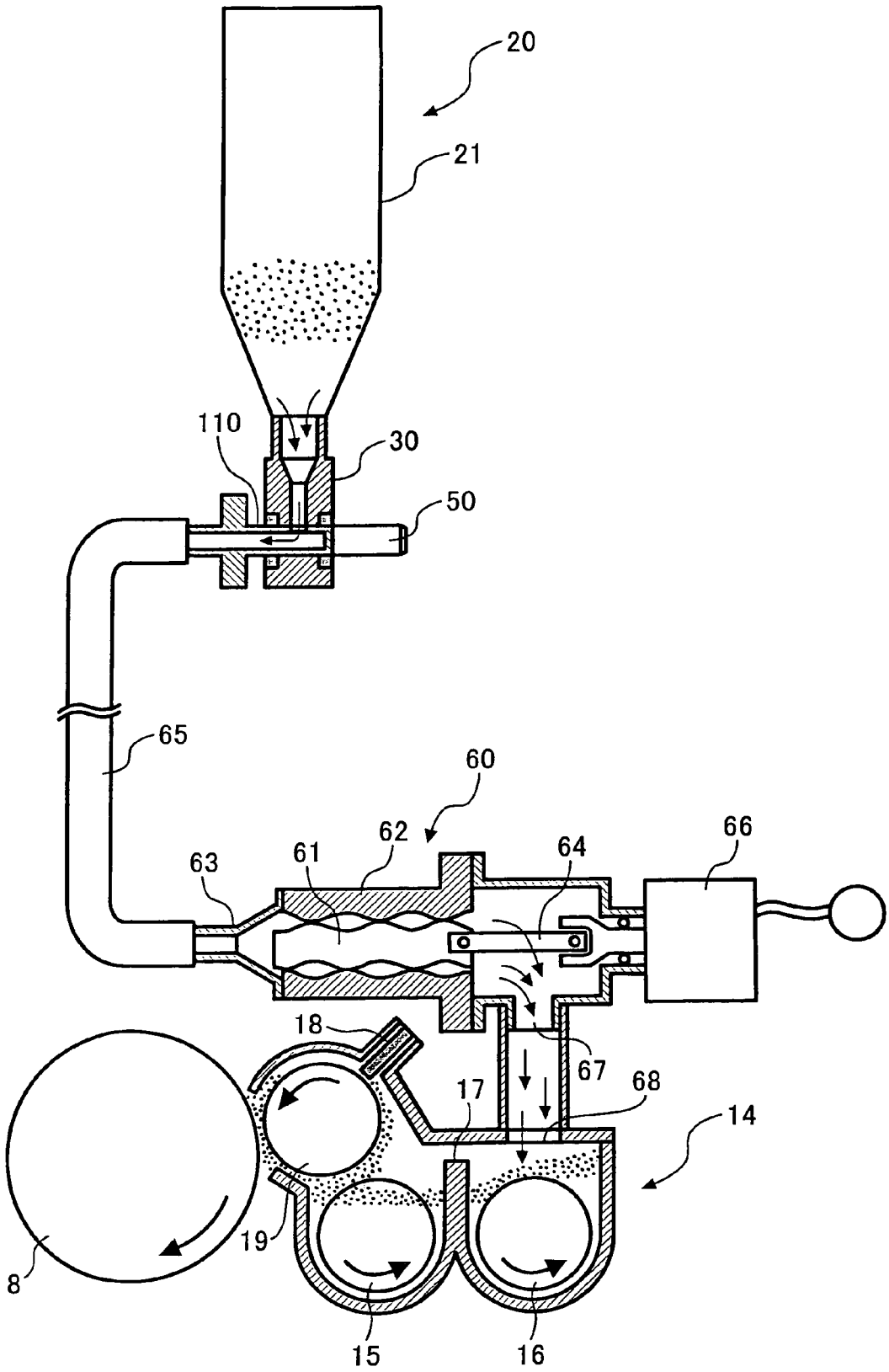
FIG. 4 is a schematic structure of a developer conveying mechanism included in the color laser printer of FIG. 3.

Referring to FIG. 4, a structure of a developer conveying mechanism is described.

Since the developer containers 20*y*, 20*m*, 20*c*, and 20*bk* have structures and functions similar to each other, except that the toners contained therein are of different colors, the discussion with respect to FIGS. 4 through 8 and FIGS. 11 through 20B generally use reference numerals for specifying components of the color laser printer 1 without suffixes of colors such as y, m, c and bk.

As shown in FIG. 4, the developer conveying mechanism mainly includes a developer container 20, a pump unit 60, and a developing unit 14.

First, components and functions of the developer container 20 will be described.

The developer container 20 includes a developer case 21 and a cap 30.

The developer case 21 is disposed with an opening portion facing down towards the cap 30 and is engaged with the cap 30.

The cap 30 is connected to the opening portion of the developer case 21 and serves as a developer discharging member. The cap 30 is also connected to a nozzle 110 and is configured to accept a cylindrical shutter member 50. The configuration of the developer container will be described in detail later.

As shown in FIG. 4, the developer container 20 is in flow communication with the developing unit 14 via a developer conveying tube 65. The developer conveying tube 65 is connected to the nozzle 110 at one end and to the pump unit 60 at the other end. The developer conveying tube 65 includes a flexible material such as rubber and resin having low toner adhesion characteristics. The developer conveying tube 65 has an inner diameter of from approximately 4 mm to approximately 10 mm.

Next, components and functions of the pump unit 60 will be described.

The pump unit 60 is a uniaxial screw pump or a mono pump. The pump unit 60 delivers the developer stored in the developer container 20 to the developing unit 14 by suction through the developer conveying tube 65. The pump unit 60 includes a rotor 61, a stator 62, a suction inlet 63, a universal joint 64, a motor 66, and a developer delivery port 67.

The rotor 61 may be a metallic or highly rigid resin shaft member having a circular cross-section and spirally twisted as a double-start screw. The rotor 61 is rotatably connected to the motor 66 by the universal joint 64. The stator 62 is formed of rubber or similar soft material and has a bore having a spirally twisted cross-section. The stator 62 has the rotor 61 disposed therein.

Now, components and functions of the developing unit 14 will be described.

The developing unit 14 generally includes first and second conveyor screws 15 and 16, a partition 17, a doctor blade 18, and a developing roller 19.

The first and second conveyor screws 15 and 16 are disposed in areas of the developing unit 14 for storing developer. Both the first and second conveyor screws 15 and 16 have respective spiral fins. The first conveyor screw 15 is disposed facing the developing roller 19.

The first and second conveyor screws 15 and 16 are rotated in directions indicated by the arrows in FIG. 4, respectively, to agitate the developer delivered from the developer accepting port 68. In the illustrative embodiment, the developer is implemented as a toner and carrier mixture.

Operations of the developer conveying mechanism will be described.

When the motor 66 rotates the rotor 61 disposed in the stator 62, the developer stored in the developer container 20 is sucked via the developer conveying tube 65 to the suction inlet 63. The toner is conveyed into a space between the rotor 61 and the stator 62, and is discharged during rotations of the rotor 61. The toner is conveyed to the developer delivery port 67, which is connected to a developer accepting port 68.

The developing unit 14 receives the developer conveyed through the developer accepting port 68. The developer is mixed with carriers contained in the developing unit 14, and is agitated by the first and second conveyor screws 15 and 16. The developer and carriers are conveyed toward the developing roller 19 so that the developer and carriers can be supplied to a surface of the developing roller 19.

The developer and carriers on the surface of the developing roller 19 are regulated by the doctor blade 18 to form a thin layer. When the regulated developer and carriers reach a developing area or a position facing the photoconductive drum 8, the developer is attracted to an electrostatic latent image formed on the surface of the photoconductive drum 8. More specifically, developer is attracted to an electrostatic latent image due to an electric field formed by a developing potential, or a difference of electric potentials, between an image portion of the electrostatic latent image irradiated by a laser beam and the developing roller 19.

Developer in the developer container 20 is supplied through the developer conveying mechanism according to consumption of developer by the developing unit 14. The state of developer consumption is indirectly detected by a reflex photo sensor (not shown) facing the photoconductive drum 8.

Figure 5:
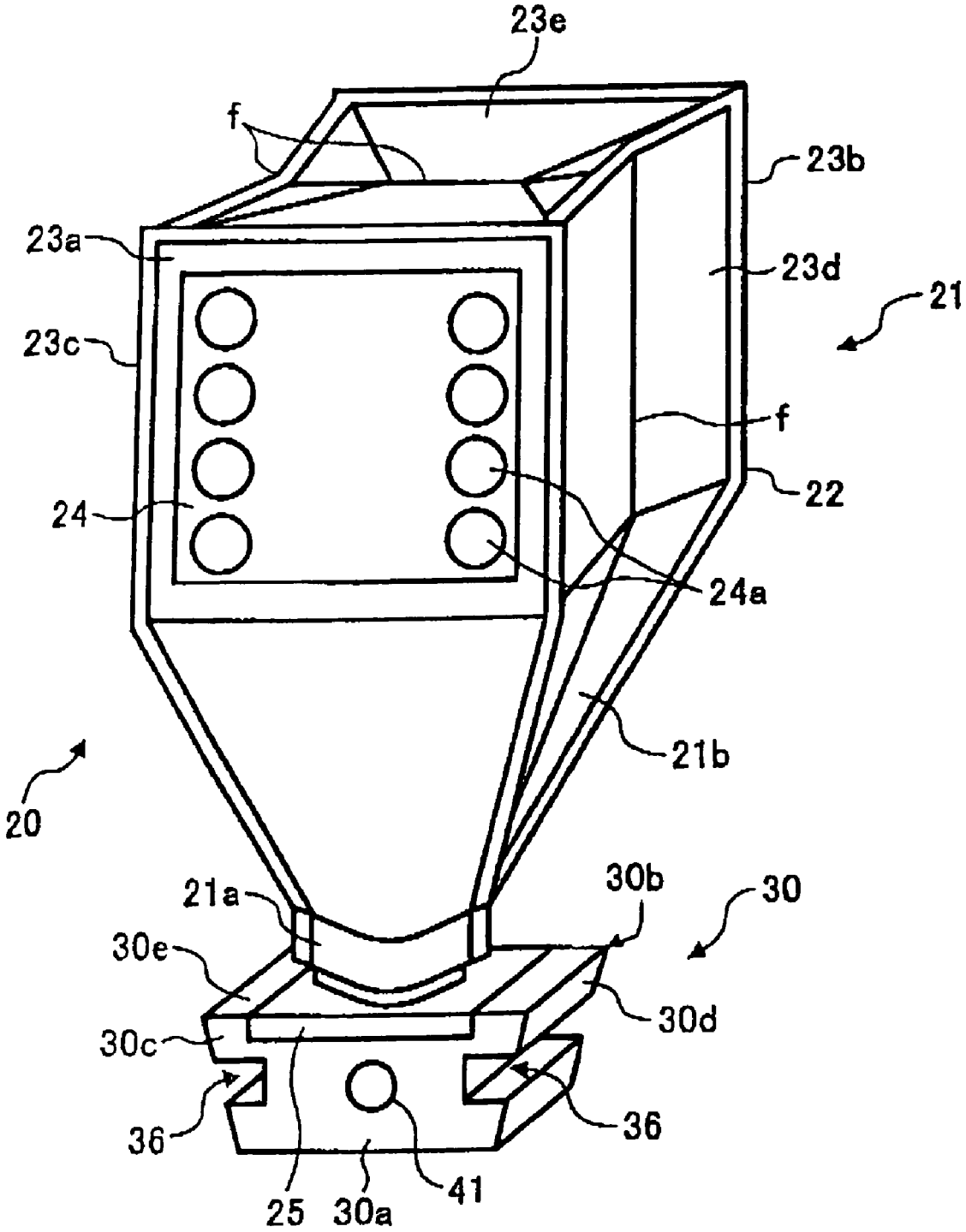
FIG. 5 is a perspective view of a bag-like developer container used in the developer conveying mechanism of FIG. 4.
Figure 6:
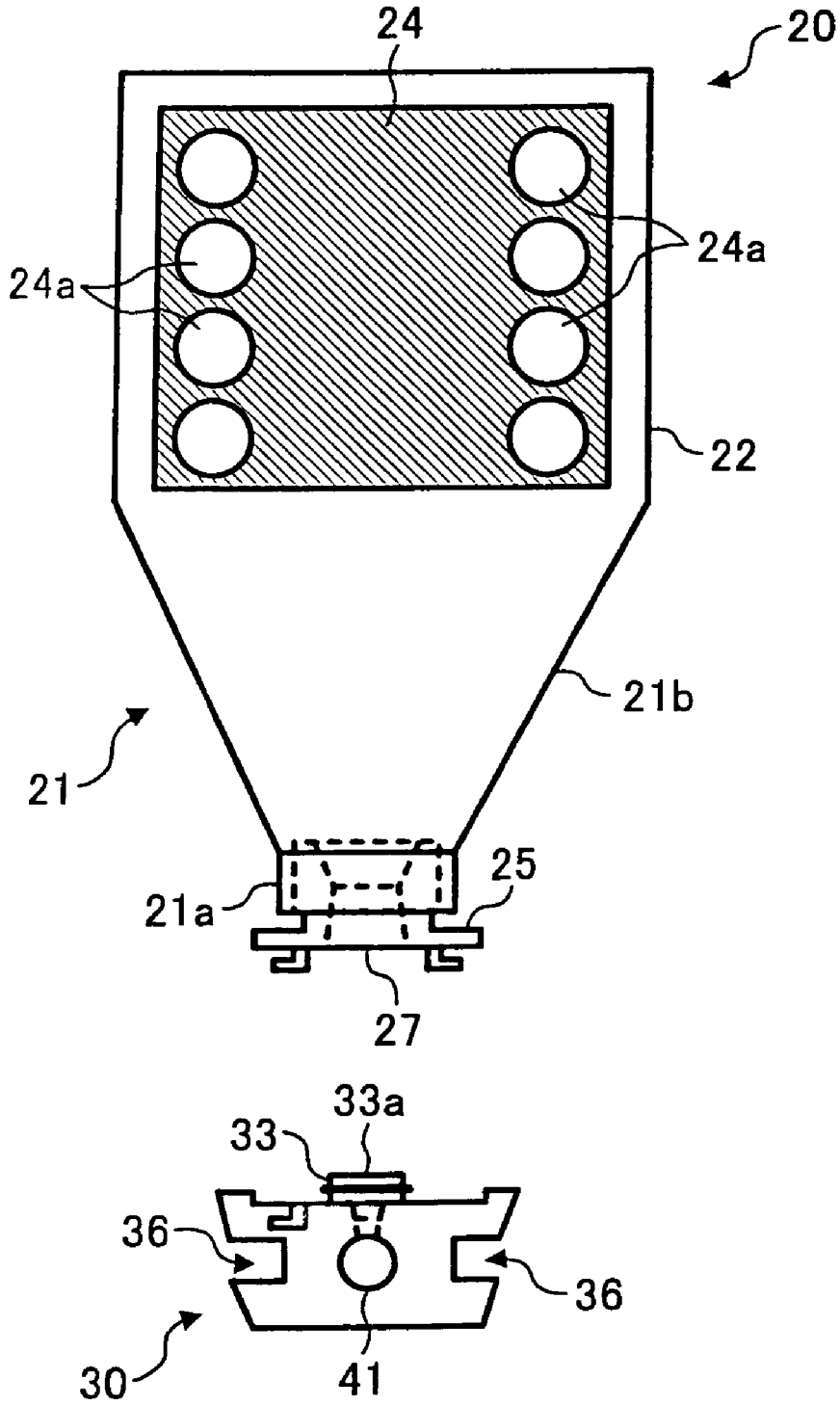
FIG. 6 is a front view of the developer container of FIG. 5.

Referring to FIGS. 5 and 6, a structure of the developer container 20 is described.

The developer container 20 includes a developer case 21 and a cap 30. The developer case 21 and the cap 30 are detachable from each other. FIG. 5 is a perspective view of the developer container 20 with the developer case 21 and the cap 30 connected with each other, and FIG. 6 is a front view of the developer container 20 when the developer case 21 and the cap 30 are separated.

The developer case 21 includes a developer bag 22 and an adaptor 25.

The developer bag 22 is formed of a flexible material and includes a plurality of sheet materials 23*a*, 23*b*, 23*c*, 23*d*, and 23*e*, which form surfaces of the developer bag 22.

The developer bag 22 is a square bag made of a single or a plurality of deformable and flexible sheet materials 23*a*, 23*b*, 23*c*, 23*d*, and 23*e* having a thickness from approximately 80 μm to approximately 200 μm. Each bag stores a single color toner. Each of the plurality of sheet members is, for example, a resin sheet of polyethylene or nylon. More specifically, the plurality of sheet materials 23*a*, 23*b*, 23*c*, 23*d*, and 23*e* are welded together at their edges to form the developer bag 22 having an opening 21*a*. With such an airtight structure, the developer bag 22 allows less air circulation. Thus, developer leakage from the developer bag 22 may be prevented, providing flexibility of folding up the developer bag 22.

In this embodiment, the plurality of sheet materials 23*a*, 23*b*, 23*c*, 23*d*, and 23*e* are welded together at their edges. However, the plurality of sheet materials 23*a*, 23*b*, 23*c*, 23*d*, and 23*e* may instead be adhered to allow less air circulation.

The sheet materials 23*c*, 23*d*, and 23*e* have respective folds f thereon, and the sheet materials 23*a* and 23*b* have respective flat portions remaining flat without being folded. Accordingly, when the developer packed in the developer bag 22 is sucked by the pump unit 60, the developer bag 22 can compactly be folded inward at the folds f.

As an inner pressure of the developer container 20 is reduced, a distance between the sheet materials 23*a* and 23*b* may become closer, such that the sheet materials 23*a* and 23*b* can contact each other. This may cause a developer conveying failure.

To avoid such a developer conveying failure, the developer bag 22 may also have at least one reinforcing sheet member 24 on at least one of the flat portions thereof. That is, the sheet materials 23*a* and 23*b* may be affixed with respective reinforcing sheet members 24 on the respective flat portions thereof.

The reinforcing sheet member 24 is configured to retain a flat surface rather than a tapered surface, so that higher developer conveying ability may be obtained. Further, the reinforcing sheet member 24 is configured to retain a large size rather than a small size, so that higher developer conveying ability may also be achieved.

The reinforcing sheet members 24 may include a resin sheet of polyethylene or nylon, having a thickness of approximately 0.5 mm.

In this embodiment, the sheet materials 23*a* and 23*b* each include a reinforcing sheet member 24. However, one reinforcing sheet member 24 may be provided for either one of the sheet materials 23*a* and 23*b*. With the reinforcing sheet members 24, the developer bag 22 may be folded along the fold f to form a compact shape more easily, without causing a stoppage of the developer flow.

Each of the reinforcing sheet members 24 has a plurality of perforations 24*a* which serve as grippers. The plurality of perforations 24*a* are arranged so that an operator can easily grip and hold the developer container 20 with his or her fingers put in the perforations 24*a*. With the plurality of perforations 24*a*, the operator can properly hold the developer container 20, thereby ensuring high installment efficiency of the developer container 20 in the color laser printer 1 or similar image forming apparatuses. The gripper is not limited to the plurality of perforations 24*a* but may include a different sheet member, for example, or a material having high friction coefficient.

Further, as shown in FIG. 5, the upper half portion of the developer bag 22 is shaped substantially like a parallelepiped and the lower half portion is shaped like an inverse quadrangular pyramid or funnel (tapered) toward the opening 21*a*. This shape of an inverse quadrangular pyramid is defined as a hopper 21*b* that is inclined downward toward the cap 30. That is, when the developer container 20 is attached to the color laser printer 1, with the opening 21*a* facing downward, developer accommodated in the developer bag 22 is effectively conveyed. More specifically, even developer stored in a vicinity of an inner surface of the developer bag 22 can smoothly slide down along a tapered surface of the hopper 21*b* toward the opening 21*a* of the developer bag 22. Therefore, developer remaining close to the inner surface of the developer bag 22 can be smoothly conveyed and should not remain in the developer bag 22.

The adaptor 25 is welded at the opening 21*a* of the developer bag 22 so that the opening 21*a* of the developer bag 22 may be hermetically sealed to an outer circumference of the adaptor 25. This ensures air tightness of the developer bag 22.

The adaptor 25 includes a developer outlet 27, which is shown in FIG. 6. The developer outlet 27 has a through hole vertically piercing the adaptor 25. With the above-described structure, the developer case 21 can smoothly discharge developer contained therein through the developer outlet 27 of the adaptor 25.

In this embodiment, the adaptor 25 is welded to the opening 21*a* of the developer bag 22. However, the adaptor 25 may be adhered or glued to the opening 21*a* of the developer bag 22 to hermetically connect the adaptor 25 to the developer bag 22.

Now, structure and functions of the cap 30 will be described, in reference to FIGS. 5 and 6.

The cap 30 is detachably disposed with respect to the adaptor 25 of the developer bag 22.

The cap 30 includes a plurality of surfaces, namely, a front face 30*a*, a rear face 30*b*, side faces 30*c* and 30*d*, and a top face 30*e*. The cap 30 also includes a funnel 33 (see FIG. 6), a tapered inlet bore 33*a* (see FIG. 6), grooves 36, and a nozzle-receiving hole 41.

The developer bag 22 is used with the cap 30 down, and the developer bag 22 communicates with the cap 30. The nozzle-receiving hole 41 has a circular-shaped longitudinal cross-sectional area. The nozzle-receiving hole 41 extends horizontally through the cap 30 between the front face 30*a* and the rear face 30*b*, and is configured to smoothly engage the nozzle 110 of the color laser printer 1 of FIG. 4. The funnel 33, including the tapered inlet bore 33*a*, is disposed on the top face of the cap 30 and serves as a developer discharging opening. The grooves 36 are formed on the respective side faces 30*c* and 30*d* of the cap 30, along a direction in which the developer container 20 is slid to be engaged with the color laser printer 1.

To attach the cap 30 to the developer bag 22, the developer outlet 27 of the adaptor 25 is connected with the tapered inlet bore 33*a* of the funnel 33. With the nozzle receiving hole 41 of the developer container 20 and the nozzle 110 of the color laser printer 1 being connected to each other, developer accommodated in the developer container 20 is supplied to the developing unit 14.

Figure 7:
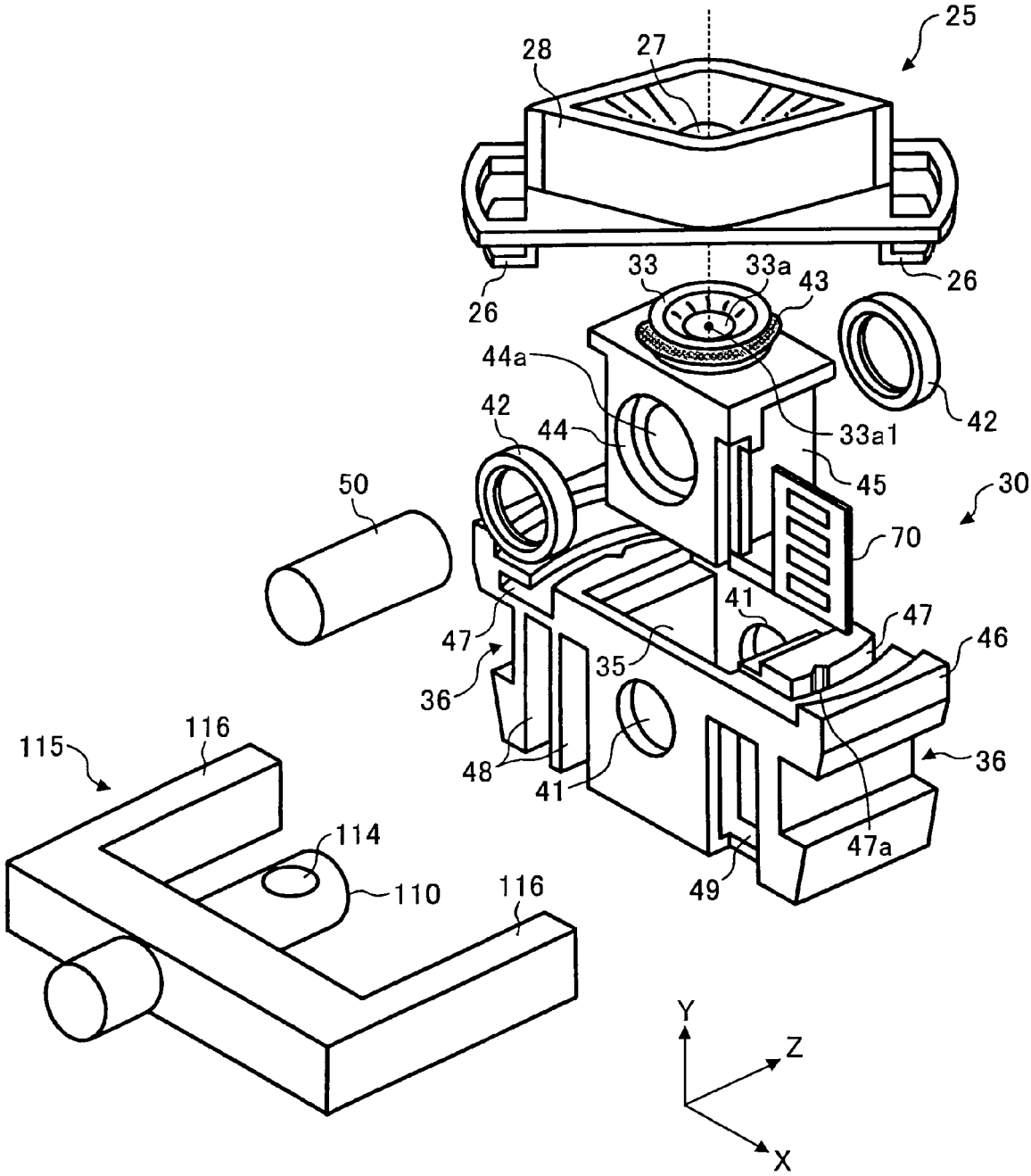
FIG. 7 is an exploded isometric view of an example of a cap and a positioning member.
Figure 8:
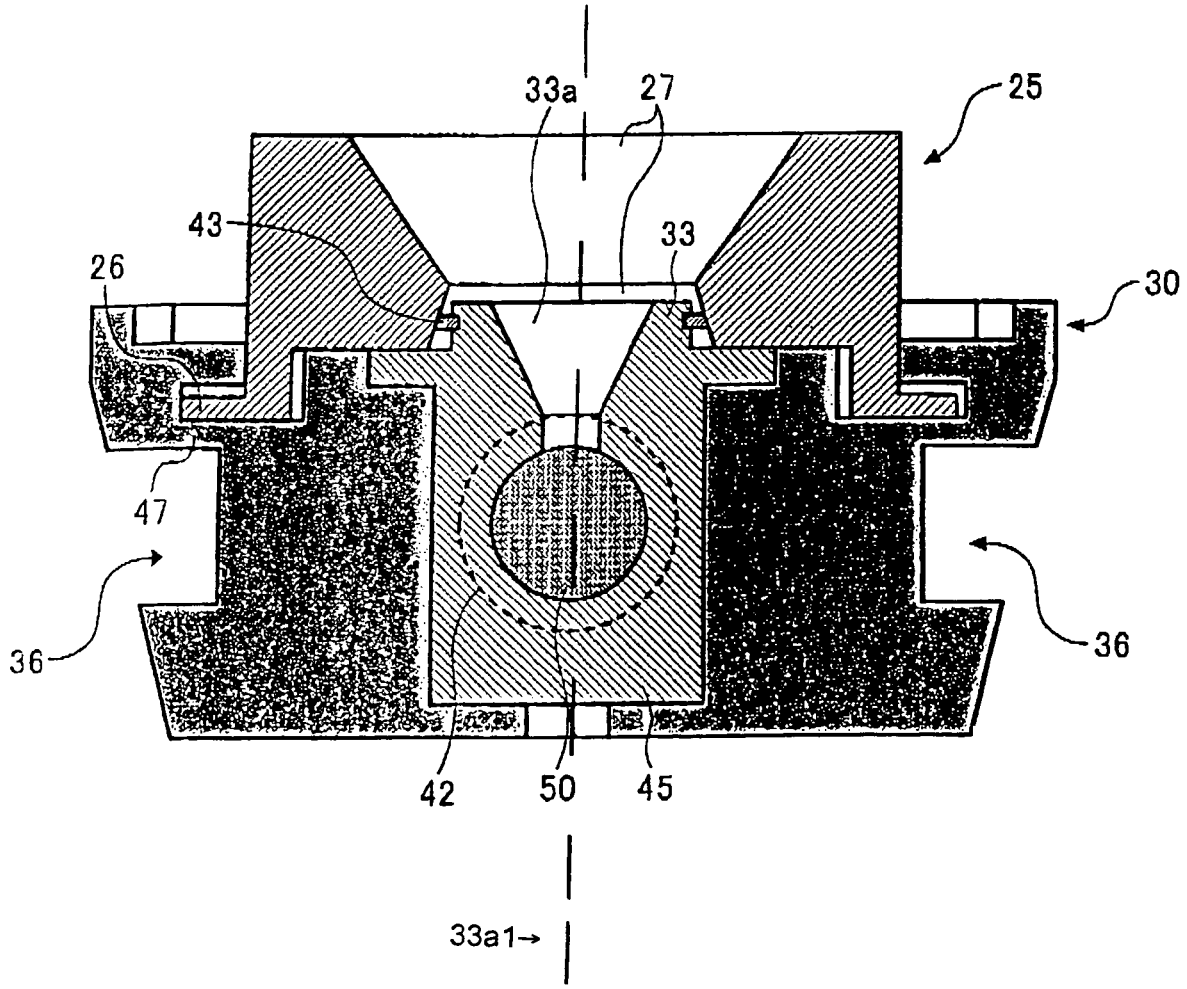
FIG. 8 is a horizontal sectional view of the cap of the developer container.

Referring to FIGS. 7 and 8, a detailed structure of the cap 30 is described.

The cap 30 of FIG. 7 includes first and second cap members 45 and 46, a shutter member 50, a lip packing 42, an O-ring 43, and an integrated circuit (or IC) chip 70. The first and second cap members 45 and 46 respectively include a resin material and are detachable from each other.

The first cap member 45 includes the funnel 33 and steps 44.

As previously shown in FIG. 6, the funnel 33 is disposed on the top face of the cap 30, facing the adaptor 25, and includes the tapered inlet bore 33*a* communicating with the developer outlet 27 of the adaptor 25. The tapered inlet bore 33*a* also communicates with a through hole 44*a* that runs in a direction indicated by arrow Z in FIG. 7. The through hole 44*a* is formed perpendicular to a flow of developer in the developer bag 22, which is a direction indicated by arrow Y in FIG. 7. The through hole 44*a* has openings at both ends. The openings of the through hole 44*a* are configured to face the respective nozzle-receiving holes 41 of the second cap member 46 when the first cap member 45 is inserted to the second cap member 46. The openings of the through hole 44*a* have the respective steps 44 to which the respective lip packings 42 such as G seals are inserted. The funnel 33 of the first cap member 45 has the O-ring 43 attached around its circumference. The funnel 33 with the O-ring 43 attached is inserted into the developer outlet 27 of the adaptor 25. The O-ring 43 serves as a sealing member at a portion where the developer outlet 27 engages with the cap 30.

The IC chip 70 is detachably attached to the first cap member 45.

The second cap member 46 includes a hollow portion 35, the grooves 36, the nozzle-receiving holes 41, a guide member 47, a crenellated portion 48, and a concave portion 49.

The hollow portion 35 is formed to have the first cap member 45 with the IC chip 70 inserted therein from the top of the second cap member 46.

As previously described, the grooves 36 are formed on the respective side faces 30*c* and 30*d* of the cap 30 to engage with a positioning member 115, which will be described later.

As previously described, the nozzle-receiving holes 41 run between the front and rear faces 30*a* and 30*b* of the cap 30. When the first cap member 45 is inserted into the hollow portion 35 of the second cap member 46, the nozzle receiving holes 41 communicate with the through hole 44*a* of the first cap member 45.

The guide member 47 is arranged on the top of the second cap member 46 to guide the adaptor 25 to be engaged with the cap 30. The guide member 47 includes a stopper groove 47*a* to position the adaptor 25 in engagement.

The crenellated portion 48 has a unique shape that is different formed from other crenellated portions of developers of different colors so that the cap 30 can accept its specified developer container 20 when the developer container 20 is inserted to be attached to the color laser printer 1.

The concave portion 49 is provided to expose the IC chip 70 when the IC chip 70 is inserted to the hollow portion 35 of the second cap member 46.

The shutter member 50 has a cylindrical shape and includes a resin material. The shutter member 50 is configured to open and close the nozzle-receiving hole 41 when attaching and detaching the developer container 20 from the color laser printer 1.

Operations of assembling the cap 30 will be described.

The first cap member 45 with the lip packings 42, the O-ring 43, and the IC chip 70 attached thereto are inserted into the hollow portion 35 of the second cap member 46. At this time, the tapered inlet bore 33*a* of the funnel 33 and the nozzle-receiving hole 41 communicate with each other to form a developer conveying path. The above-described assembly can convey developer in the developer case 21 through the developer outlet 27 and the tapered inlet bore 33*a* of the funnel 33. The developer is discharged from the nozzle-receiving hole 41 running in the direction as indicated by the arrow Z, which is perpendicular to the flow of the developer as indicated by the arrow Y. More specifically, the nozzle-receiving hole 41 and the through hole 44*a* are engaged with the nozzle 110 of the color laser printer 1 so that the developer conveyed from the tapered inlet bore 33*a* of the funnel 33 can be discharged via the nozzle 110.

The cylindrical shutter member 50 is then inserted into the nozzle-receiving hole 41. When an outer circumference of the shutter member 50 is held in contact with a lip portion provided at an inner circumference of the lip packing 42 with the shutter member 50 attached, developer conveyed by the tapered inlet bore 33*a* can be prevented from leaking through the nozzle-receiving hole 41. The function of the shutter member 50 will be described later.

After performing the above-described assembling, the cap 30 is engaged with the adaptor 25 of the developer case 21. Operations of attaching the developer container 20 will be described.

First, developer is packed by a dedicated filling machine (not shown) through the developer outlet 27 of the adaptor 25 into the developer case 21. At this time, the developer outlet 27 of the adaptor 25 faces upward towards an opening of the filling machine that opens in a direction of gravitational force. This may help the developer fall by its own weight from the opening of the filling machine and be directly conveyed into the developer case 21 via the developer outlet 27.

As described above, the cap 30 detachably connected to the developer case 21 has the nozzle-receiving hole 41 opening in a direction different from the opening direction of the developer outlet 27 of the developer case 21. Thus, by detaching the cap 30 when developer is packed to the developer case 21, the direction of a flow of developer for filling the developer can be identical to the direction of a flow of developer when falling due to gravity. This simplifies a structure of developer filling machine and a method of filling developer cases.

The developer case 21 in one embodiment integrally includes the adaptor 25 and the developer bag 22 by welding at a welding portion 28, shown in FIG. 7, of the adaptor 25 with the opening 21*a* of the developer bag 22. However, a method of connecting the adaptor 25 and the developer bag 22 together is not limited to a welding method. For example, the adaptor 25 may be glued to the opening 21*a* of the developer bag 22.

The cap 30 is then mounted on the developer case 21 packed with developer. More specifically, the developer outlet 27 of the adaptor 25 of the developer case 21 is held facing upward while inserting the funnel 33 of the cap 30 into the developer outlet 27. At this time, according to FIG. 7, the adaptor 25 is attached to the cap 30 by turning the cap 30 by a certain angle, which centers a central axis 33*a*1 (shown in FIG. 8) of the tapered inlet bore 33*a* with respect to the cap 30.

After the funnel 33 of the cap 30 is inserted into the developer outlet 27 of the adaptor 25, the cap 30 is turned, centering the central axis 33*a*1 of the tapered inlet bore 33*a*. Central axis 33*a*1 is equal to a central axis of the developer outlet 27. That is, the cap 30 is turned to engage an engaging portion 26 of the adaptor 25 with the guide member 47 of the second cap member 46. Then, a protruding portion arranged at the engaging portion 26 is engaged with the stopper groove 47*a* of the guide member 47, completing the engagement of the adaptor 25 and the cap 30 as shown in FIG. 8.

In this embodiment, the adaptor 25 and the cap 30 are separate parts and are integrally adhered by welding or other adhering methods. However, a configuration of the adaptor 25 and the cap 30 is not limited only to that described above. For example, an embodiment of the present invention can use a configuration of the adaptor 25 and the cap 30 formed as a single member including a single material. This can bring production costs down.

When the developer container 20 assembled as described above is mounted to the color laser printer 1, a positioning member 115 disposed in the color laser printer 1 will be engaged with the cap 30 of the developer container 20 in synchronization with a movement of the attachment of the developer container 20.

As shown in FIG. 7, the positioning member 115 integrally includes the nozzle 110 having an opening 114, and two arms 116.

A span of the two arms 116 of the positioning member 115 is substantially equal to that of the grooves 36 of the second cap member 46 of the cap 30, so that the two arms 116 can engage with the grooves 36. The engagement of the two arms 116 and the grooves 36 regulates a movement of the cap 30 in vertical and horizontal directions, indicated by arrows X and Y in FIG. 7. That is, the positioning member 115 allows the cap 30 to move in the Z direction to be inserted thereto, and prevents the cap 30 from moving in the X and Y directions that are perpendicular to the Z direction in FIG. 7. Thus, the positioning member 115 determines a position of the cap 30 in the X and Y directions.

The nozzle 110 attached to the positioning member 115 has a circular shape in a longitudinal cross sectional area to match the shape of the nozzle-receiving hole 41. When the nozzle 110 is engaged with the nozzle-receiving hole 41 of the cap 30, the opening 114 of the nozzle 110 communicates with the tapered inlet bore 33*a*, so that developer can be supplied from the developer container 20 to the developing unit 14, as previously described in FIG. 4.

Referring now to FIGS. 9 through 12, operations for attaching and detaching the developer container 20 to the color laser printer 1 are described.

Figure 9:
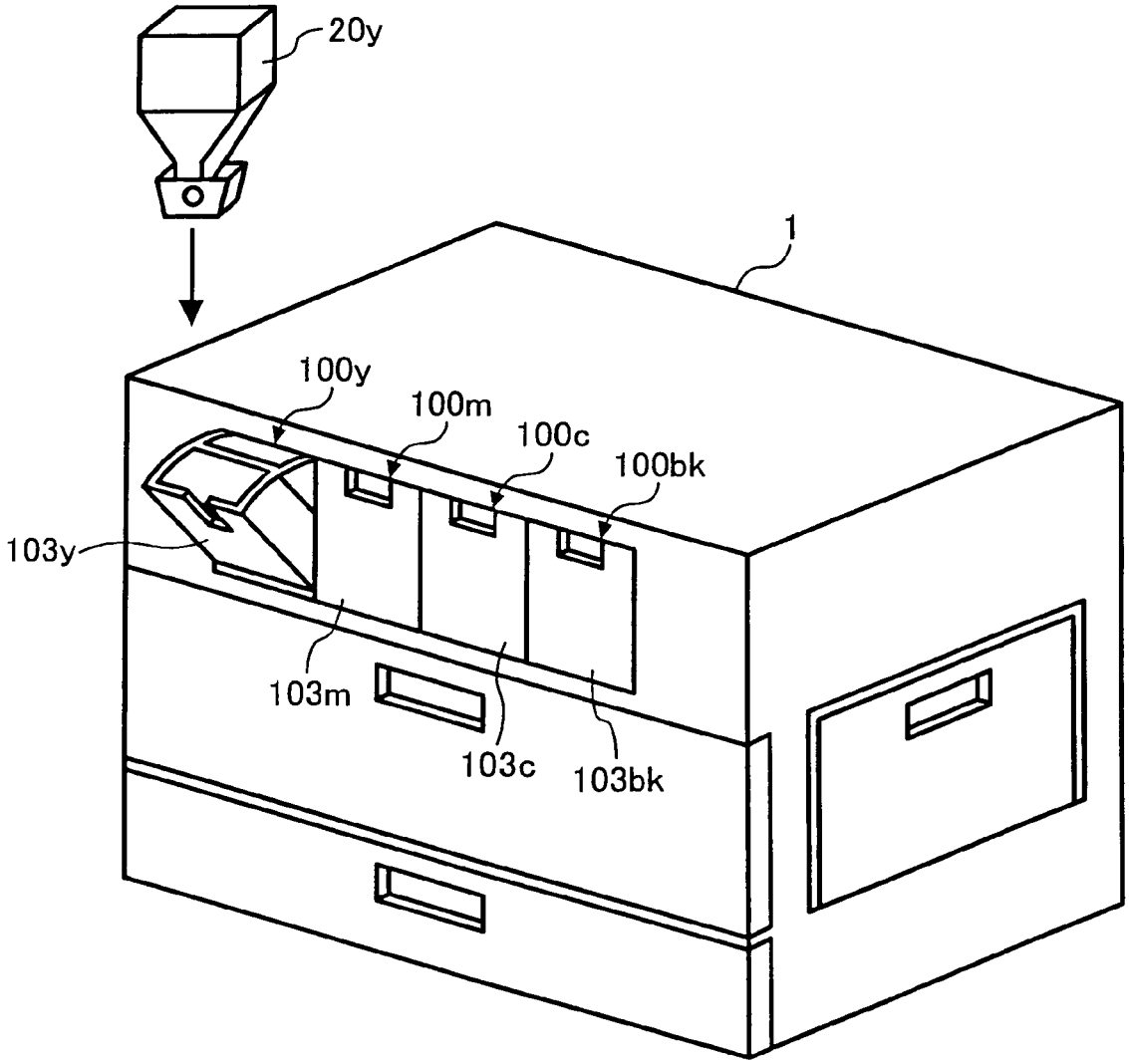
FIG. 9 is an external perspective view of the color laser printer of FIG. 3.
Figure 11:
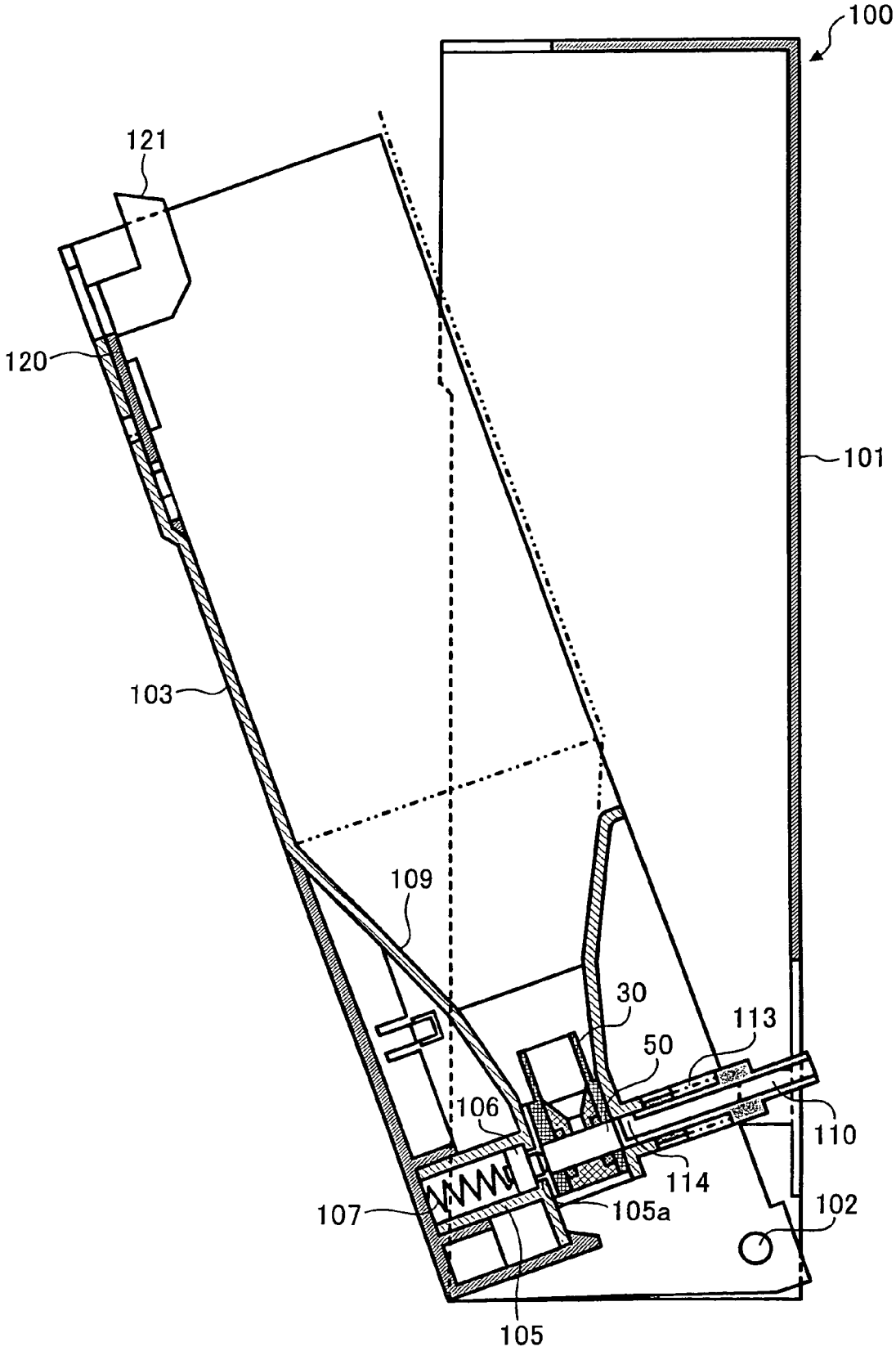
FIG. 11 is a sectional view showing the holder of FIG. 10B included in a mount portion in an open position.
Figure 12:
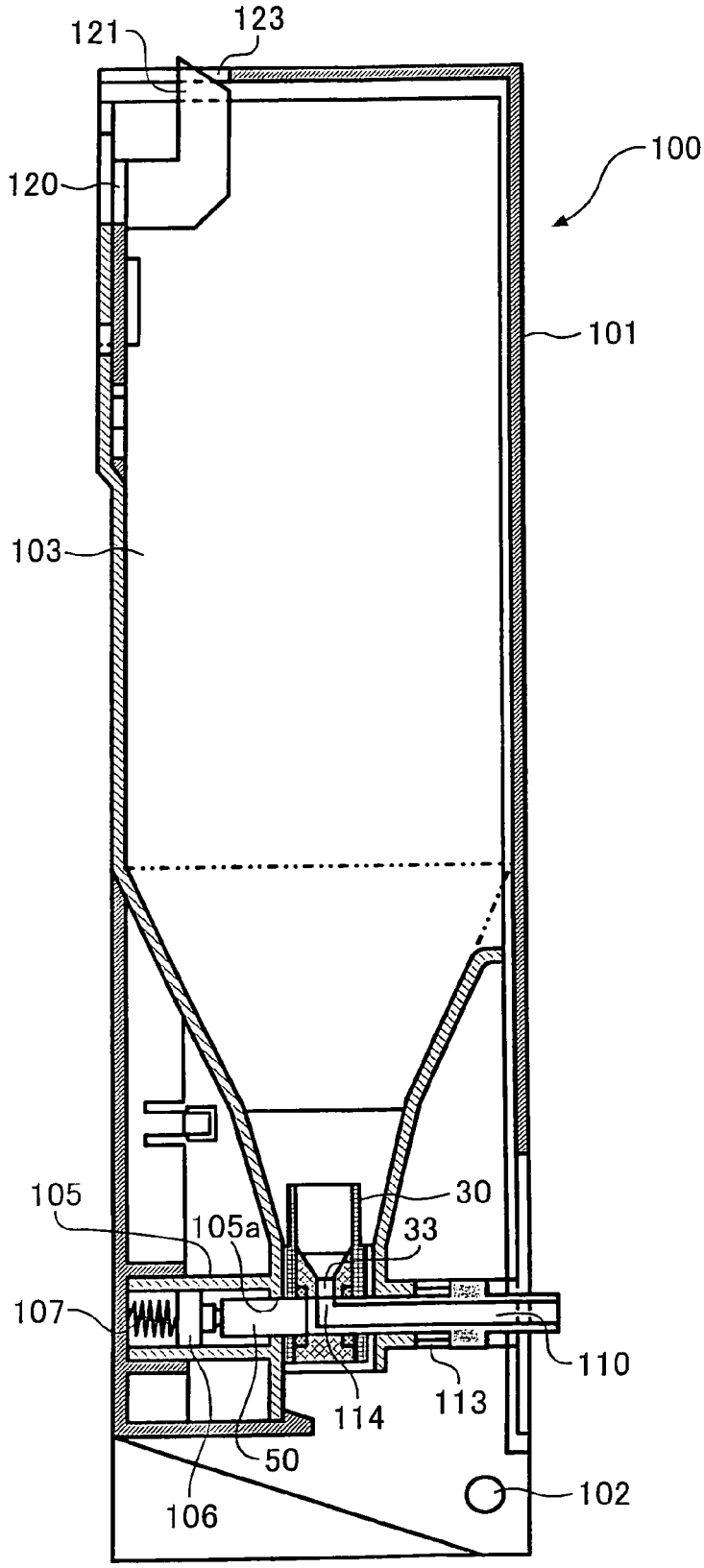
FIG. 12 is a sectional view showing the holder of FIG. 10B included in the mount portion in a closed position.

As shown in FIG. 9, the color laser printer 1 includes four mount portions 101*y*, 100*m*, 100*c*, and 100*bk* with respective holders 103*y*, 103*m*, 103*c*, and 103*bk* hinged to a frame 101 (see FIGS. 11 and 12) and angularly movable between an open position as shown in FIG. 11 and a closed position shown in FIG. 12. The four mount portions 100*y*, 100*m*, 100*c*, and 100*bk* are identical in configuration with each other, and the holders 103*y*, 103*m*, 103*c*, and 103*bk* are identical in configuration with each other.

Each cap 30 of the corresponding developer container 20 is designed to have a unique shape different from other developer containers to prevent the use of a developer container having a color different from a specified color of developer. More specifically, each cap 30 has its unique crenellated portion 48 at the front and back faces of the cap 30.

Developer cases for identical color developers have caps with identical shapes. That is, the developer containers 20*y*, 20*m*, 20*c*, and 20*bk* include respective developer cases with respective caps having different shapes. With the above-described structure, developer containers are incompatible according to the color of the developers and can be provided at a relatively low cost.

Figure 10B:
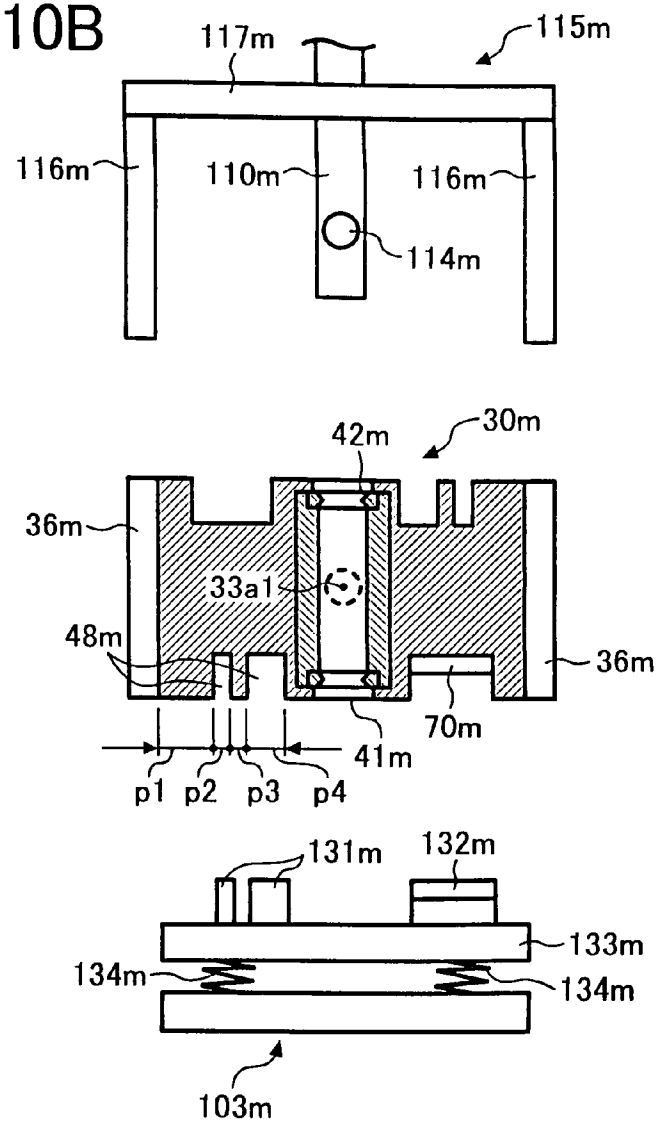
FIG. 10B is a horizontal cross sectional view of a cap corresponding to a magenta toner positioning member and a holder.
Figure 10A:
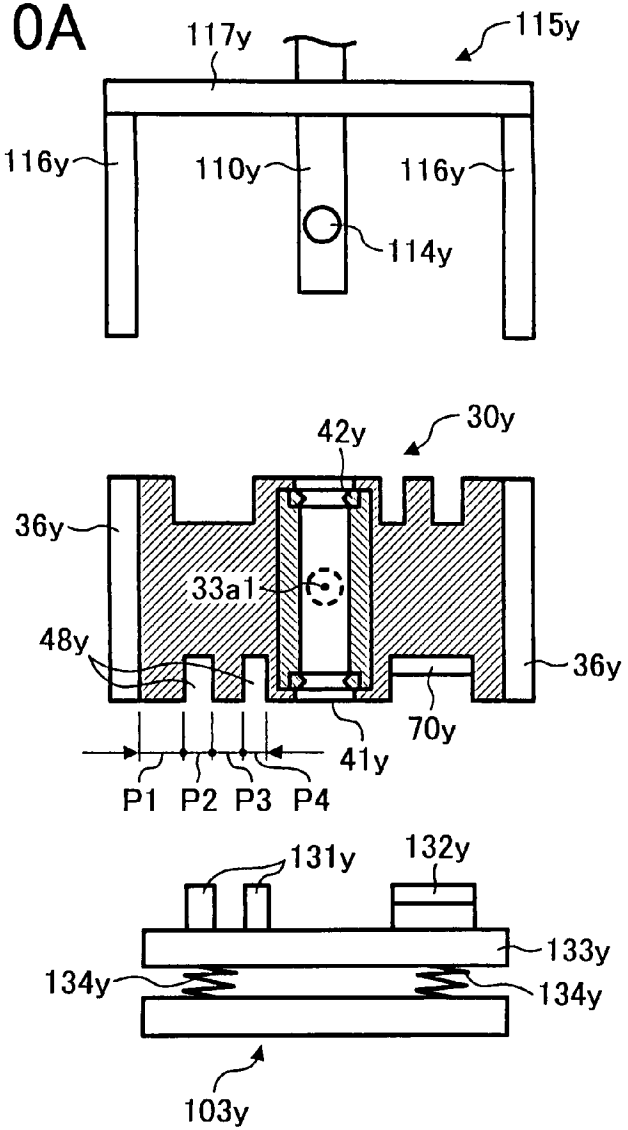
FIG. 10A is a horizontal cross sectional view of a cap corresponding to a yellow toner positioning member and a holder.

Referring now to FIGS. 10A and 10B, respective structures of mount portions 100*y* and 100*m* are described. FIG. 10A shows a horizontal sectional view of the mount portion 100*y* mounting the developer container 20*y* with the cap 30*y* for yellow toner, and FIG. 10B shows a horizontal sectional view of the mount portion 100*m* mounting the developer container 20*m* with the cap 30*m* for magenta toner. Since the mount portions 30*c* and 30*bk* with the caps 30*c* and 30*bk* corresponding to cyan and black toners have similar structures to the mount portions 100*c* and 100*bk* with the caps 30*y* and 30*m*, except shapes of the crenellated portions 48*y*, 48*m*, 48*c*, and 48*bk*, the drawings of the mount portions 100*c* and 100*bk* are omitted.

As shown in FIGS. 10A and 10B, the mount portions 100*y* and 100*m* include the holders 103*y* and 103*m*, respectively. The holders 103*y* and 103*m* engage the caps 30*y* and 30*m*, which engage the positioning members 115*y* and 115*m*, respectively.

The caps 30*y* and 30*m* have different shapes at the respective crenellated portions 48*y* and 48*m* to avoid mounting a developer container having a different color of developer from a specified developer. More specifically, the cap 30*y* of FIG. 10A has the crenellated portion 48*y* with pitches P1, P2, P3, and P4, and, the cap 30*m* of FIG. 10B has the crenellated portion 48*m* with pitches p1, p2, p3, and p4. As shown in FIGS. 10A and 10B, the pitch P1 is different from the pitch p1, the pitch P2 is different from the pitch p2, the pitch P3 is different from the pitch p3, and the pitch P4 is different from the pitch p4.

The holder 103*y* as shown in FIG. 10A includes a protruding portion 131*y*, a connection terminal 132*y*, a plate 133*y*, and a spring 134*y*. Since the holder 103*m* shown in FIG. 10B may include similar components as the holder 103*y*, except shapes of a protruding portion 131*m*, explanation of the related components will be omitted. Further, the description will be given regarding to the cap 30*y*, and that of the cap 30*m* will be described when needed.

The holder 103*y* includes the protruding portion 131*y* on the plate 133*y* that faces the cap 30*y*, so that the protruding portion 131*y* can be engaged with the crenellated portion 48*y*. With the above-described structure, the developer container 20*y* corresponding to yellow toner cannot be mounted to the mount portion 100*m* for magenta toner. Thus, different structures of the caps including the caps 30*y* and 30*m* can ensure incompatibility, to prevent an image defect due to mixture of different developers.

As shown in FIG. 10A, the cap 30*y* holds the IC chip 70*y*, and the holder 103*y* of the mount portion 100*y* has the connection terminal 132*y* on the plate 133*y* thereof to be electrically connected to the IC chip 70*y*.

The IC chip 70*y* stores information related to the developer, such as colors, serial numbers or production lots, dates of manufacture, etc., and information related to recycling, such as numbers of times, dates, recycling manufacturer names, etc.

When the developer container 20*y* is mounted to the mount portion 100*y*, information stored in the IC chip 70*y* is transferred via the connection terminal 132*y* to a controller of the color laser printer 1. Based on the information, the color laser printer 1 is correctly controlled. For example, when the color laser printer 1 detects that a color of a developer is different from a color of a specific developer, the color laser printer 1 may stop operations of the developer conveying mechanism or may change an image forming condition according to its corresponding serial numbers and recycling manufacturer names. Accordingly, the IC chip 70*y* allows the color laser printer 1 to easily determine the developer container condition and history.

The positioning member 115*y* is disposed at an inward or rear side of a frame 101 (see FIGS. 11 and 12). When a user mounts the developer container 20*y* to the mount portion 100*y* and subsequently closes the door of the holder 103*y* to the closed position as shown in FIG. 12, the cap 30*y* is pushed toward the rear side of the frame 101 and is sandwiched between the plate 133*y* of the holder 103*y* and a supporting plate 117*y* of the positioning member 115*y*. More specifically, when the cap 30*y* is sandwiched between the plate 133*y* arranged at the door of the holder 103*y* and the supporting plate 117*y* of the positioning member 115*y*, springs 134*y* disposed between the plate 133*y* and the holder 103*y* push the plate 133*y* toward the cap 30*y*, thereby positioning the cap 30*y* on a surface of the supporting plate 117*y*.

When the holder 103*y* of the mount portion 100*y* mounting the developer container 20*y* is closed to the closed position as shown in FIG. 12, the positioning member 115*y* and the cap 30*y* are engaged as previously described with FIG. 7.

Now, detailed functions of the mount portion 100 and its opening and closing operations are described, in reference to FIGS. 11 and 12. In FIGS. 11 and 12, the developer container 20 is illustrated without the developer bag 22 but with the cap 30. The mount portion 100 shown in FIGS. 11 and 12 is described without suffixes of portions and components since the developer containers to be mounted are basically identical to each other, except as described above.

The mount portion 100 includes the frame 101, a shaft 102, the holder 103, a guide tube 105, a slider 106, compression springs 107 and 113, a guide frame 109, a door knob 120, a locking pawl 121, and a stopper groove 123.

The shaft 102 serves as a pivot for opening and closing the holder 103 with respect to the frame 101. With the shaft 102, the holder 103 is angularly movable between the open position as shown in FIG. 11 and the closed position as shown in FIG. 12. The developer container 20 is mounted when the holder 103 is in the open position.

The guide tube 105 is arranged at the lower portion of the holder 103, extending along the axis of the nozzle 110. The guide tube 105 is formed with a hole 105*a* for inserting the shutter member 50 at the end portion facing the nozzle 110.

The slider 106 pushes back towards the nozzle 110, which is inserted and is slidably received in the guide tube 105. The slider 106 is formed with a projection.

The compression spring 107 is disposed in the guide tube 105 and constantly biases the slider 106 toward the nozzle 110. The compression spring 107 presses the slider 106 to the right of FIG. 11.

The guide frame 109 is disposed in the holder 103 for guiding the developer container 20 toward a mount position. The nozzle 110 is positioned in the lowermost portion of the guide frame 109, which is configured to receive the lower body portion of the cap 30. Holes are formed in the guide frame 109 to allow the nozzle 110 and the shutter member 50 to pass therethrough.

The compression spring 113 is wound around the nozzle 110 in the gap between the nozzle 110 and the holder 103. The compression spring 113 presses the nozzle towards the right of FIG. 11.

The door knob 120 is movable in the up-and-down direction and is mounted on the upper portion of the holder 103 and includes the locking pawl 121. The door knob 120 is constantly biased toward the uppermost position.

The locking pawl 121 is configured to lock the holder 103 in the closed position.

The stopper groove 123 is arranged in the upper portion of the frame 101 and is configured to receive the locking pawl 121 when the holder 103 is in the closed position.

To mount the developer container 20 to the mount portion 100, a user pulls the door knob 120 toward the user while moving it downward, which releases the locking pawl 121 from the stopper groove 123. As shown in FIG. 11, the holder 103 can be angularly moved or opened about the shaft 102 to a position where the holder 103 abuts against the frame 101. In this condition, the developer container 20 is inserted in the holder 103 along the guide frame 109 of the holder 103. At the same time, the crenellated portion 48 of the cap 30 and the protruding portion 131 of the holder 103 are engaged.

As shown in FIG. 11, when the holder 103 is in the open position, the shutter member 50 connected to the cap 30 keeps the nozzle-receiving hole 41 closed. That is, the slider 106 arranged in the guide tube 105 is pressed by the compression spring 107 to the hole 105*a* of the guide tube 105. The nozzle 110 is pressed by the compression spring 113 to a position away from the shutter member 50.

Subsequently, when the user closes the holder 103 to the closed position as shown in FIG. 12, the user pushes the knob 120 toward the frame 101, and the locking pawl 121 is latched at the stopper groove 123, thereby positioning the holder 103 in the frame 101.

When the holder 103 is in the closed position as shown in FIG. 12, the shutter member 50 mounted to the cap 30 opens the nozzle-receiving hole 41. More specifically, when the holder 103 is closed, the positioning member 115 is pressed against the frame 101, thereby the nozzle 110 and the two arms 116 of the positioning member are engaged with the cap 30. At the same time, the shutter member 50 attached to the cap 50 is pressed to the left of FIG. 12, and the opening 114 of the nozzle 110 is brought into communication with the tapered inlet bore 33*a* of the funnel 33 of the cap 30. The slider 106 in the guide tube 105 is forcedly pressed to the left in FIG. 12 by the shutter member 50 in a direction against a pressure applied by the compression spring 107.

At this time, the outer circumference of the nozzle 110 is held in contact with the inner circumference of the lip packing 42 to prevent leakage of developer from a portion between the nozzle 110 and the cap 30.

Thus, developer packed in the developer container 20 may be conveyed by the developer conveying mechanism via the nozzle 110 to the developing unit 14, as shown in FIG. 4.

To remove the developer container 20 from the mount portion 100, the user may take opposite procedures to the mounting operation described above.

To briefly describe this process, when the holder 103 is pulled out to open, the positioning member 115 is released from the cap 30. At the same time, the nozzle 110 is retracted from the cap 30 by the pressure applied by the compression spring 113, and the slider 106 is moved by the pressure applied by the compression spring 107 to move the shutter member 50 to the right in FIG. 11. Thus, the nozzle-receiving hole 41 of the cap 30 is closed by the shutter member 50.

Accordingly, when developer packed in the developer container 20 described above becomes almost empty, the developer container 20 folds inward at the folds f so that the volume of the developer bag 22 of the developer container 20 becomes flat and compact, thereby reducing transportation cost when the developer container 20 is collected and transported to a recycling manufacturer. In a process of disassembling the developing container 20, the developer case 21 and the cap 30 may easily be disassembled, resulting in high operability. Using the lip packing 42 and the O-ring 43 as sealing members for the cap 30 may cause less deterioration of the sealing members, which provides high operability in replacement of sealing members. Even after the disassembly process, since the opening 21*a* of the developer bag 22 is designed to have a same direction as the developer outlet 27 of the adaptor 25, the developer case 21 can be relatively easily cleaned before another developer is packed in the developer case 21.

As described above, in the first embodiment of image forming, the developer container 20 is configured to have the developer outlet 27 of the developer case 21 run perpendicular to the nozzle-receiving hole 41 of the cap 30 to which the nozzle 110 is engaged.

With the above-described structure, the developer container 20 may be flexibly disposed without limiting a size of an image forming apparatus and the developer container 20 itself. That is, the developer container 20 may provide flexibility to layouts of the color laser printer 1 including the developer container 20.

As previously described, the reinforcing sheet member 24 is formed to have a bowed shape.

Referring to FIGS. 13 through 20B, detailed descriptions are given to show how the bowed shape of the reinforcing sheet member 24 is made.

Figure 13:
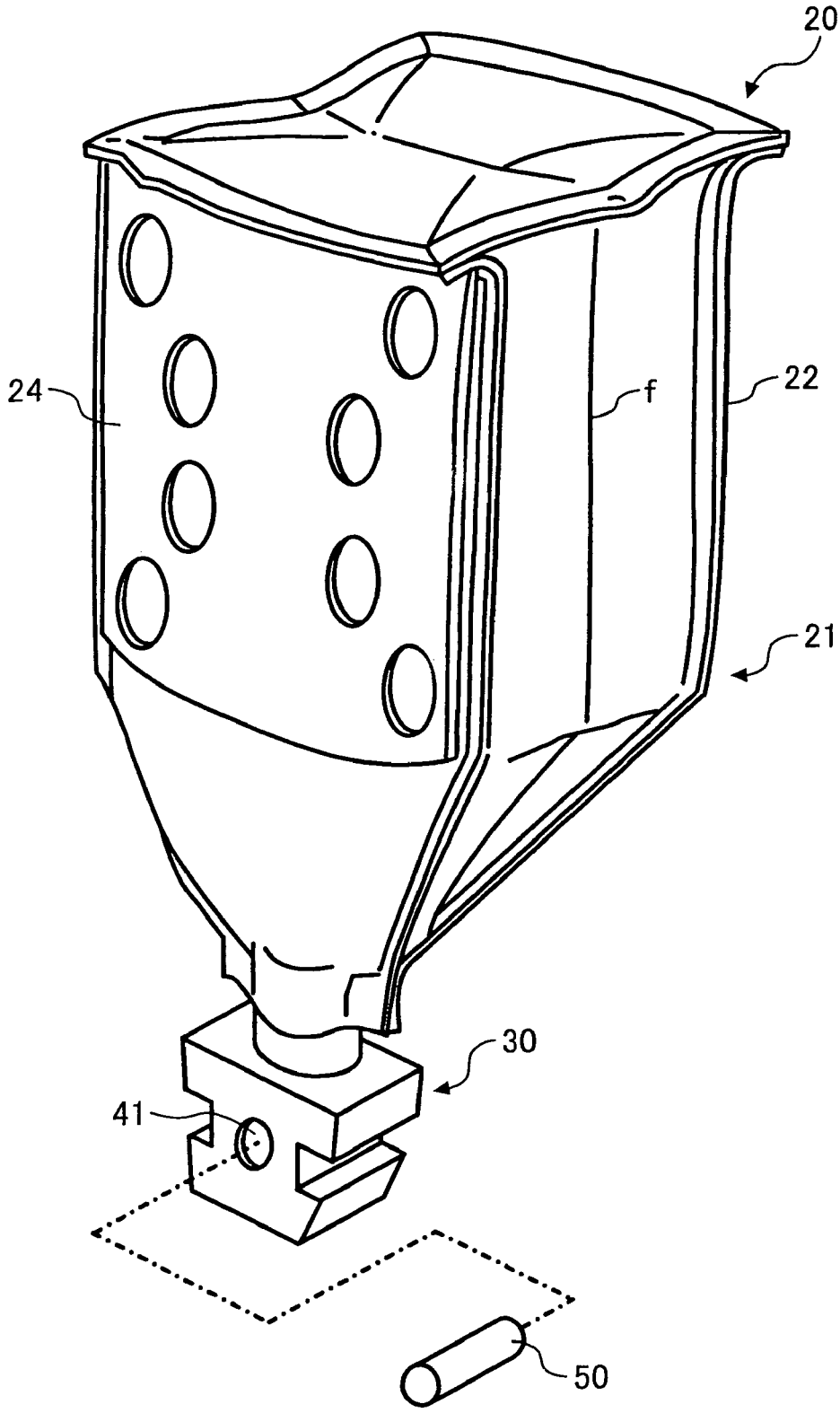
FIG. 13 is a perspective view of a bag-like developer container used in the developer conveying mechanism of FIG. 4.

As shown in FIG. 13, the reinforcing sheet member 24 is attached to a flat surface of the developer bag 22 of the developer case 21. Since the reinforcing sheet member 24 is formed to have a bowed curve outwardly extending from the developer bag 22, respective inner sides of the flat surfaces of the developer bag 22 may not hermetically be held in contact with each other. Thus, even when the inner pressure of the developer bag 22 is reduced, a path for developer to pass through is kept open.

Since the components and portions described in FIG. 13 are basically same as those described in FIG. 5, detailed descriptions will be omitted.

Figure 14A:
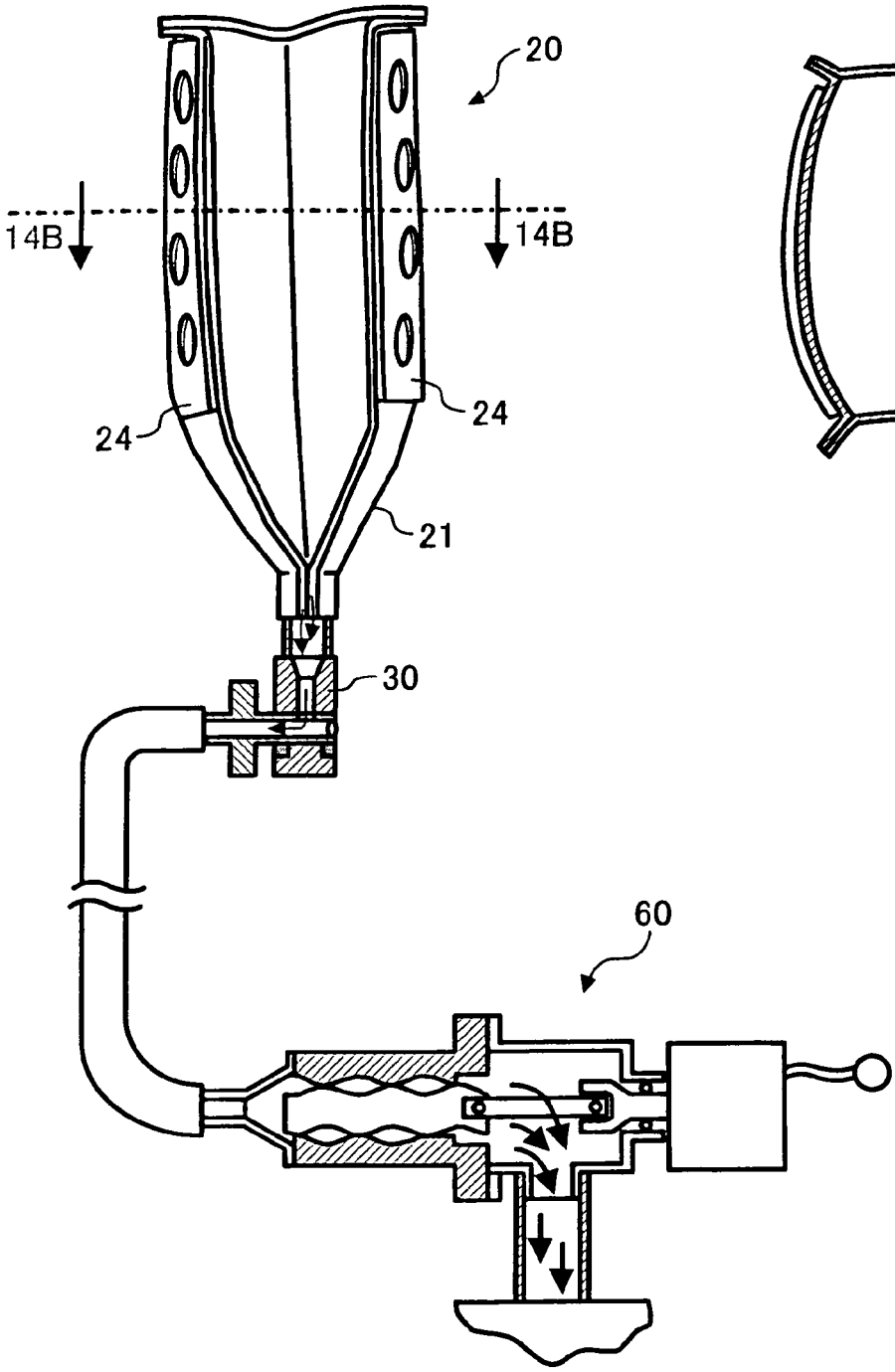
FIG. 14A is a schematic structure of a developer conveying mechanism with the bag-like developer container of FIG. 13.
Figure 14B:
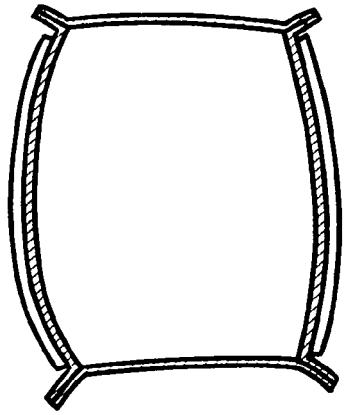
FIG. 14B is a horizontal cross sectional view of the bag-like developer container of FIG. 14A.

In FIG. 14A, a schematic structure of the developer conveying mechanism is described. Since the components and portions described in FIG. 14A are basically similar to those described in FIG. 4, except the developer container 20 of FIG. 14A is a bag-like developer case 21 attached with the reinforcing sheet members 24 on respective flat surfaces. As shown in FIG. 14B, the reinforcing sheet members 24 have a bowed curve shape, which slightly expands a volume or size of the developer case 21 and allows developer to smoothly flow therethrough. Even when developer packed in the developer case 21 runs short and comes to an end and the inner pressure of the developer case 21 is reduced, the reinforcing sheet members 24 may prevent close contact of the flat surfaces and keep the path for developer open. Thus, developer remaining at the upper portion of the developer case 21 is smoothly discharged.

As shown in one embodiment illustrated in FIGS. 14A and 14B, the bowed curve in the reinforcing sheet members 24 is configured such that a center portion of the reinforcing sheet member extends in an outward direction from the surface of the bag more than an edge portion of the reinforcing sheet member.

Figure 15B:
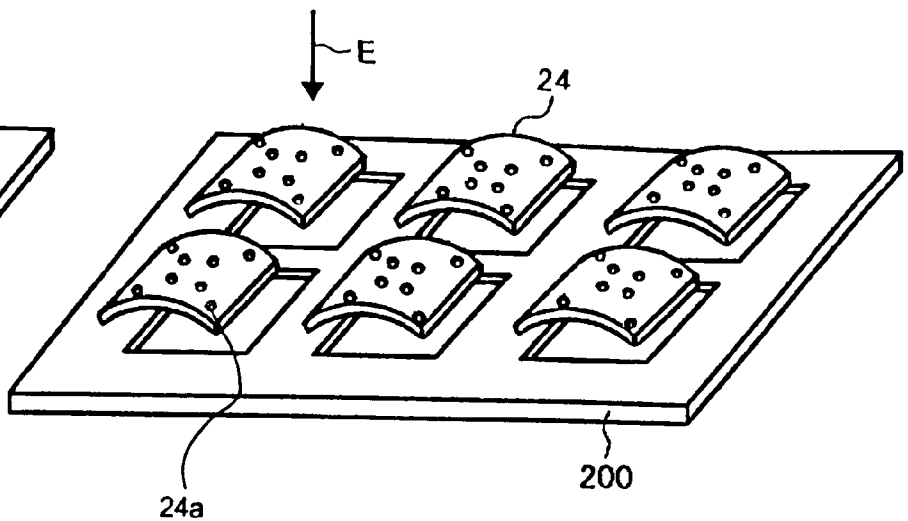
FIG. 15B illustrates another step of the manufacturing process described in FIG. 15A.
Figure 15A:
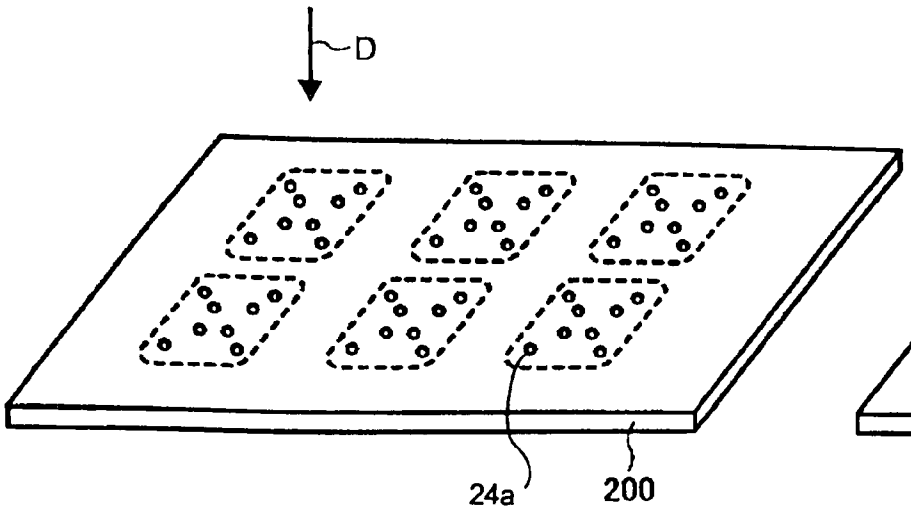
FIG. 15A illustrates one step of a process for manufacturing reinforcing sheet members including a bowed curve.

As shown in FIGS. 15A through 17, the reinforcing sheet member 24 is cut out from a large original sheet material 200 (hereinafter, referred to as an original sheet material 200) by using a blanking die. At the same time, a bowed curve in the reinforcing sheet member 24 may be formed. One original sheet material 200 can provide a plurality of reinforcing sheet members 24. Each reinforcing sheet member 24 can have a plurality of perforations 24*a*. In FIGS. 15A and 15B, the original sheet material 200 can provide six reinforcing sheet members 24, each of which having eight perforations 24*a* serving as grippers. The number of reinforcing sheet members 24 cut out from the original sheet material 200 according to the embodiment is not limited to six. That is, the sheet member may have a number of reinforcing sheet members other than six reinforcing sheet members and the reinforcing sheet members may have a number of perforations other than eight perforations.

In FIG. 15A, the original sheet material 200 has the perforations 24*a* punched by a punching die so that a user can easily pick up the developer bag 22 attached with the reinforcing sheet member or sheet members 24 with the tips of his or her fingers. The punching die moves from a top surface of the original sheet material 200, that is, in a direction indicated by arrow D. A bottom surface of the original sheet material 200 of FIG. 15A has a two-sided adhesive attached so that the reinforcing sheet member 24 can adhere to the flat portion of the developer bag 22.

In FIG. 15B, six reinforcing sheet members 24 with respective perforations 24*a* are cut out from the original sheet material 200 by a Victoria blanking die. The Victoria blanking die performs a blanking operation moving from the top surface of the original sheet material 200, that is, in a direction indicated by arrow E. While cutting, the Victoria blanking die can bow the reinforcing sheet member 24 to form a bowed curve, as shown in FIG. 15B. More specifically, the blanking operation can create a bowed curve on the reinforcing sheet member 24 having the top surface projecting upward. That is, the bottom surface having the two-sided adhesive can be caved in. The bowed curve can be created because the hardness of the top surface and the bottom surface are different. In a case in which the original sheet material 200 made of a rather hard material has the two-sided adhesive made of a rather soft material adhered on the bottom surface as previously described, if the original sheet material 200 is blanked from the top surface by the Victoria blanking die, the original sheet material 200 is deformed when the original sheet member is cut with blades of the Victoria blanking die.

FIG. 15B also illustrates an embodiment where perforations 24*a* in the reinforcing sheet member are arranged to form an arc. Specifically, the perforations 24*a* form two arcs in the reinforcing sheet members 24 shown in FIG. 15B.

After the punching operation of FIG. 15A, the original sheet material 200 can be set upside down to cut out the reinforcing sheet member 24 from the opposite side in which the perforations 24*a* are punched. Since a bowed curve is created in the blanking operation, additional features can be made without increasing steps.

Figure 16:
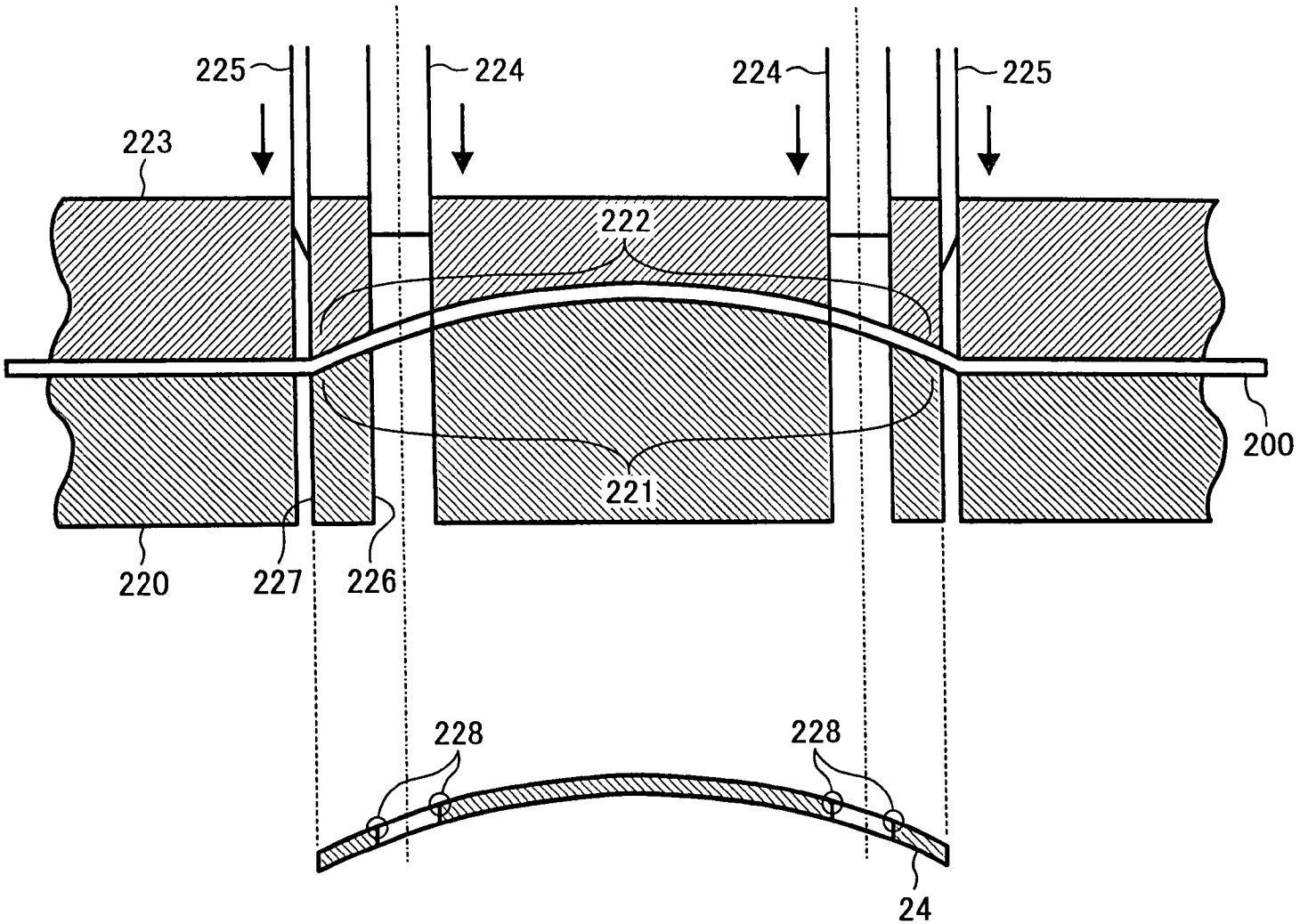
FIG. 16 illustrates an alternative example of a process for manufacturing the reinforcing sheet members described in FIGS. 15A and 15B.
Figure 17:
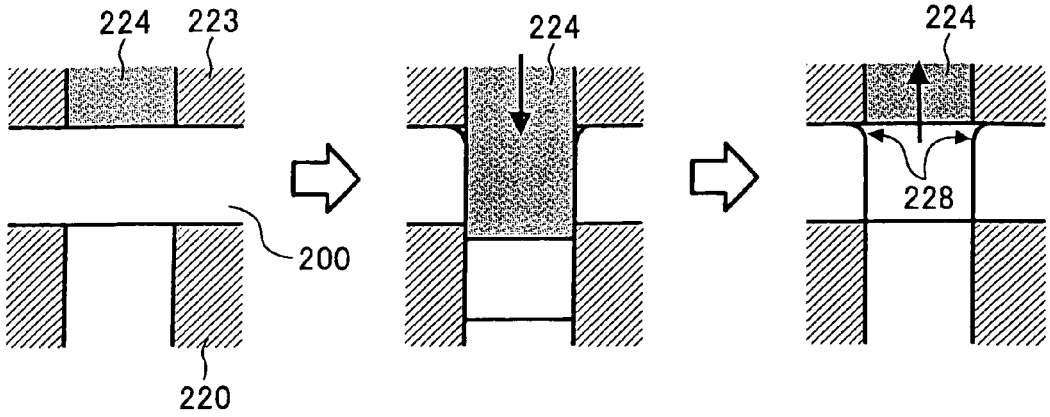
FIG. 17 illustrates a process of forming round corners of the holes in the reinforcing sheet member of FIG. 16.

The punching and blanking operations described in reference to FIGS. 15A and 15B may be performed at one time when using a technique and tool as shown in FIGS. 16 and 17.

Referring to FIG. 16, a structure of a die 220 and a tool 223 that are used to perform a simultaneous punching and blanking operation is described. FIG. 16 is a cross sectional view of the die 220 and tool 223 showing how the reinforcing sheet member 24 is cut out and punched at the same time. In FIG. 16, the die 220 and the tool 223 sandwich the original sheet material 200. A convex portion 221 of the die 220 and a concave portion 222 of the tool 223 can form a bowed curve in the reinforcing sheet member 24.

The die 220 and the tool 223 respectively include holes 226 and slits 227. The holes 226 are formed to allow pins 224 to pass through to punch the perforations 24*a*. The slits 227 are formed to allow blanking dies 225 to pass through to cut the original sheet material 200 for producing the reinforcing sheet members 24. When performing the punching and blanking operations at the same time, the pins 224 and the blanking dies 225 are simultaneously driven. A cross sectional view of one reinforcing sheet member 24 cut out with the perforations 24*a* punched is shown at a lower portion of FIG. 16. By increasing the curvature of the convex portion 221 of the die 220, a degree of the bowed curve of the reinforcing sheet member 24 can be increased. The reinforcing sheet member 24 in FIG. 16 may include corners 228 at a position corresponding to each hole 226.

As an alternative, a die having a flat surface without convex portions can also form a bowed curve in the reinforcing sheet member 24 with the blanking operation performed as shown in FIG. 15B.

Examples of suitable materials of the reinforcing sheet member 24 are a resin such as polyethylene terephthalate (PET) or polystyrene (PS), a heavy paper, or a metal sheet such as a stainless sheet or an aluminum sheet, etc. In one embodiment, a PS sheet may be used because of its low cost. In another embodiment, a metal sheet may also be used because it is easier to control the metal sheet compared to a sheet including other materials, thereby adding esthetic taste to its appearance. A thickness of the suitable material of the reinforcing sheet member 24 may be in a range from approximately 50 μm to approximately 400 μm for a resin sheet, in a range from approximately 150 μm to approximately 1000 μm for a heavy paper, and in a range from approximately 10 μm to approximately 300 μm for a metal sheet.

When high impact polystyrene (also referred to as "HIPS") is used as a material for the reinforcing sheet member 24, the corners 228 made at respective top edges of the perforations 24*a* may be rounded so that a user does not feel uncomfortable when he or she grips the developer container 20 at the perforations 24*a*. As shown in FIG. 17, roundness of the corners 228 may be provided when the perforations 24*a* are formed by punching the original sheet material 200. When a soft material such as the high impact polystyrene resin is punched, the shearing stress of the pins 224 may help round the corners 228 of the perforations 24*a* of the reinforcing sheet member 24. For example, high impact polystyrene pellets are dissolved and colored to prepare a sheet or roll material having a thickness of 250 μm with a two-sided adhesive. When the above-described sheet or roll material is punched by the punching die, rounded corners were made. However, corners of a hard material such as the PET resin cannot be rounded.

The bowed curve can also be formed when the perforations 24*a* are made while an injection molding process is performed.

Figure 18A:
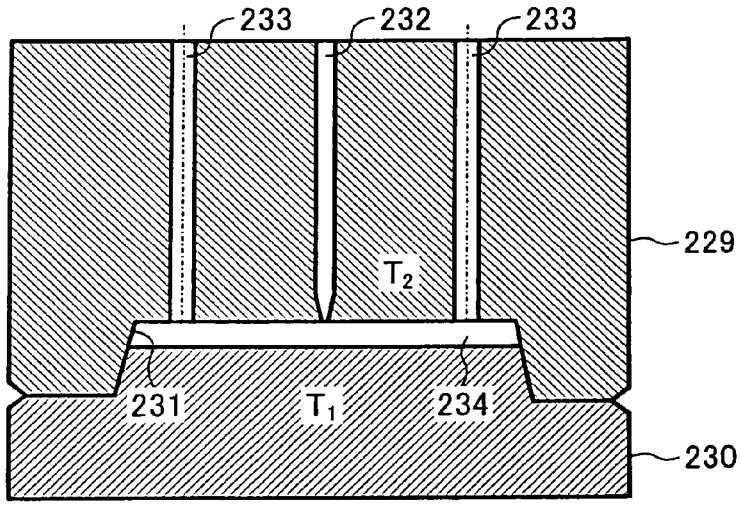
FIG. 18A illustrates another example of a process for manufacturing reinforcing sheet members.
Figure 18B:
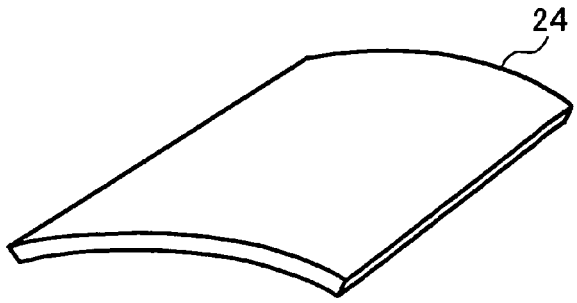
FIG. 18B illustrates one reinforcing sheet member with a bowed curve manufactured according to FIG. 18A.

Referring to FIGS. 18A and 18B, the injection molding of the reinforcing sheet member 24 is described according to another example of forming a bowed curve in the reinforcing sheet member 24.

In FIG. 18A, injection molding is performed with a fixed injection mold 229 and a movable injection mold 230 to form a resin plate 234 in a gap or a resin injection space 231.

The fixed injection mold 229 includes a gate 232 and holes 233. The gate 232 communicates with the resin injection space 231 and the holes 233 are formed to allow eject pins (not shown) to pass through the fixed injection mold 229 to the resin injection space 231. The resin plate 234 is a raw material of the reinforcing sheet member 24.

The fixed and movable injection molds 229 and 230 may have different temperatures when forming the resin plate 234. For example, a temperature T1 of the movable injection mold 230 can be lower than a temperature T2 of the fixed injection mold 229.

After resin is injected into the resin injection space 231, the temperature T1 of the movable injection mold 230 starts to drop. Thus, solidification or contraction of the resin plate 234 near mold 230 may begin sooner than solidification near the fixed injection mold 229 does. Since one surface of the resin plate 234 that faces the movable injection mold 230 starts to shrink while a different surface of the resin plate 234 that faces the fixed injection mold 229 is still soft enough to bend, the surface facing the movable injection mold 230 becomes stretched. The soft, stretched surface is adhered to the flat surface of the developer case 21 of the developer container 20. If necessary, a printing operation may be performed onto the surface facing the fixed injection mold 229. Accordingly, the resin plate 234 may be formed as shown in FIG. 18B.

The bowed curve can also be formed when the perforations 24*a* are made while an ultraviolet irradiation is performed.

Figure 19A:
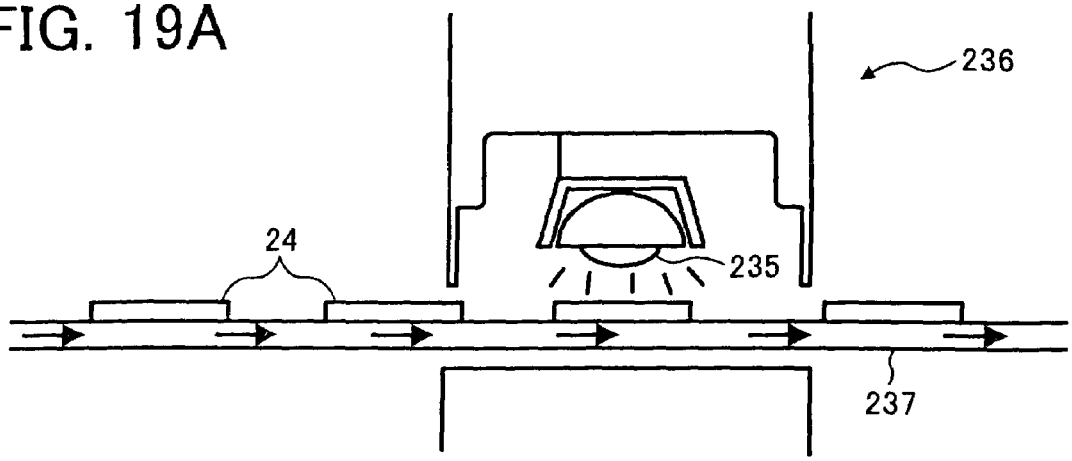
FIG. 19A illustrates another example of manufacturing reinforcing materials.
Figure 19B:
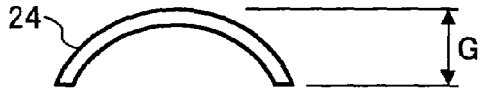
FIG. 19B illustrates a height of the bowed curve of one reinforcing sheet member according to FIG. 19A.

Referring to FIGS. 19A and 19B, an ultraviolet irradiation for forming the bowed curve in the reinforcing sheet member 24 is described according to another exemplary embodiment.

As shown in FIG. 19A, ultraviolet irradiation is performed by using an ultraviolet irradiating system 236. The ultraviolet irradiating system 236 includes an ultraviolet lamp 235 and a conveying belt 237. The conveying belt 237 conveys the reinforcing sheet member 24. The ultraviolet lamp 235 emits ultraviolet rays to irradiate the surface of the reinforcing sheet member 24. When the ultraviolet rays irradiate the reinforcing sheet member 24, the surface of the reinforcing sheet member 24 may curl down by a substantially constant height G, as shown in FIG. 19B, under conditions described later. The reinforcing sheet member 24 is curled down because the surface irradiated by the ultraviolet rays increases in length more than the opposite surface of the reinforcing sheet member 24. In one exemplary embodiment, high impact polystyrene pellets are dissolved and colored to prepare a large sheet member having a thickness of 250 μm. After adhering a two-sided adhesive to one side, the sheet member is cut into the reinforcing sheet members 24 having a length of 12.5 mm in a longitudinal direction according to a flow of developer, and a width of 11.5 mm in a lateral direction perpendicular to the longitudinal direction.

Figure 20A:
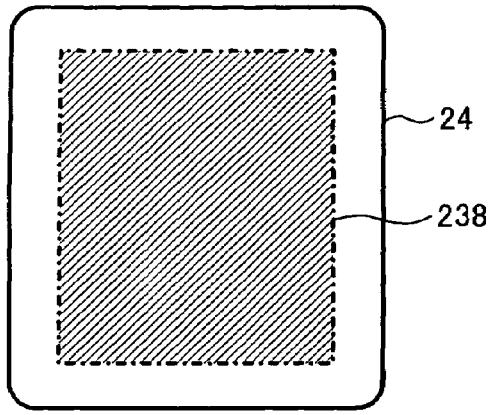
FIG. 20A shows a printing area on a surface of a reinforcing sheet member.

Referring to FIG. 20A, a printing area 238 of the reinforcing sheet member 24 is described.

The reinforcing sheet member 24 indicates the printing area 238 with hatching as shown in FIG. 20A. Instructions including identification of developer color may be printed in serigraph with ink for writing on high impact polystyrene. The printing operation may be performed before the ultraviolet irradiation. With the ultraviolet irradiation, drying the ink on the printing area 238 and forming a bowed curve on the reinforcing sheet member 24 can be performed in one process. The height of the lamp 235 to a surface of the conveying belt 237 may be in a range from approximately 160 mm to approximately 180 mm. The power of the lamp 235 may be in a range from approximately 2 kW to approximately 3 kW. The travel speed of the conveying belt 237 may be in a range from approximately 250 cm/min to approximately 270 cm/min. Under the above-described conditions, the ultraviolet irradiation can provide a substantially constant height G of a bowed curve of the reinforcing sheet member 24 as shown in FIG. 19B.

Alternatively, in this example, the bowed curve may be made because the resin plate forming the reinforcing sheet member 24 might be longer than the two sided adhesive attached to the reinforcing sheet member 24 when the reinforcing sheet member 24 is irradiated.

As previously described, the ultraviolet irradiation can dry the ink on the printing area 238 and form a bowed curve on the reinforcing sheet member 24 in one process. This example provides a reduction of manpower, since the drying operation to dry the ink on the printing area 238 and the applying operation to form a bowed curve on the reinforcing sheet member 24 can be performed at the same time.

Table 1 shows measurement results for evaluating a developer discharging ability of various reinforcing sheet members under various conditions in Examples 1 to 4 and Comparative Examples 1 to 3. These reinforcing sheet members were evaluated with the developer conveying mechanism shown in FIG. 14A.

Examples 1 through 4 were prepared under the same conditions, except the travel speeds, of the conveying belt 237. Examples 1 through 4 were prepared with reinforcing sheet members according to the preceding embodiments, each having a bowed shape curving outwardly from a developer case. Comparative Example 1 was prepared with reinforcing sheet members having a flat shape. Comparative Examples 2 and 3 were prepared with reinforcing sheet members each having an opposite bowed shape to those used in Examples 1 through 4. That is, Comparative Examples 2 and 3 used reinforcing sheet members each having a bowed shape curving inwardly to a developer case.

In the column of "Evaluation" in Table 1, "Good" signifies that the developer discharging ability per unit of time constantly stays within a standard range in which a misdetection of toner exhaustion is not likely to occur. Here, the "misdetection of toner exhaustion" is a situation where the toner exhaustion is detected when the developer container still has developer therein. "Acceptable" signifies that there is a low probability of a misdetection of toner exhaustion, although the developer discharging ability per unit of time may occasionally be out of the standard range. "Poor" signifies that there is a high probability of a misdetection of toner exhaustion when a large amount of the developer is still contained in the developer container 20. When the evaluation is "Good", a constant amount of developer is discharged per unit of time in a range according to the suction pressure of the pump unit 60 until the toner is exhausted. When the evaluation is "Acceptable", the amount of developer in the developer container 20 is less than or equal to 100 g and the amount of developer per unit of time sometimes drops below the standard level, even though the frequency of this occurrence is low. When the evaluation is "Poor", the amount of developer in the developer container 20 is less than or equal to 200 g and the amount of developer per unit of time frequently drops below the standard level.

When developer is intermittently sucked, a width between surfaces of the reinforcing sheet members 24 may become smaller, and the discharging amount of developer may be reduced. A period of suction by the pump unit 60 lasts in a range from approximately 1 sec to approximately 6 sec per operation. However, the period of suction may vary according to the amount of developer to be consumed in an image forming apparatus. A suction pressure applied by the pump unit 60 is set to greater than or equal to 3 kPa.

Figure 20B:
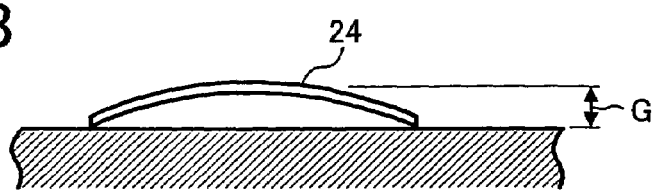
FIG. 20B shows a height of the bowed curve of one reinforcing sheet member according to FIG. 20A.

The "Height of Bowed Curve" of the reinforcing sheet member 24 in Table 1 is a height indicated by a reference G in FIG. 20B.

In the column of "No" in Table 1, "E" stands for "Example," and "CE" stands for "Comparative Example."

TABLE 1

| No. | Blanking (for Bowed Curve) | Ultraviolet Irradiation | Height of Bowed Curve | Reference | Evaluation |
|---|---|---|---|---|---|
| E 1 | Yes | Yes | 11.5 | — | Good |
| E 2 | Yes | Yes | 8.5 | — | Good |
| E 3 | Yes | Yes | 8.0 | — | Good |
| E 4 | No | Yes | 6.0 | — | Acceptable |
| CE 1 | No | No | 0.0 | — | Poor |
| CE 2 | Yes | Yes | −8.0 | Bowed inwardly, opposite to Example 3 | Poor |
| CE 3 | Yes | Yes | −11.5 | Bowed inwardly, opposite to Example 1 | Acceptable |

According to the measurement results of Table 1, when the reinforcing sheet member 24 has a bowed curve outwardly extending and adhered to a flat surface of the developer container 20, the developer container 20 may have high developer discharging ability. Even when the inner pressure and volume of the developer container 20 was reduced due to suction by the pump unit 60, the reinforcing sheet members 24 attached on the respective flat surfaces facing each other of the developer container 20 prevented close contact of the flat surfaces. This allowed the developer remaining at the upper portion of the developer container 20 to be surely discharged, thereby obtaining high discharging ability of developer.

Figure 21:
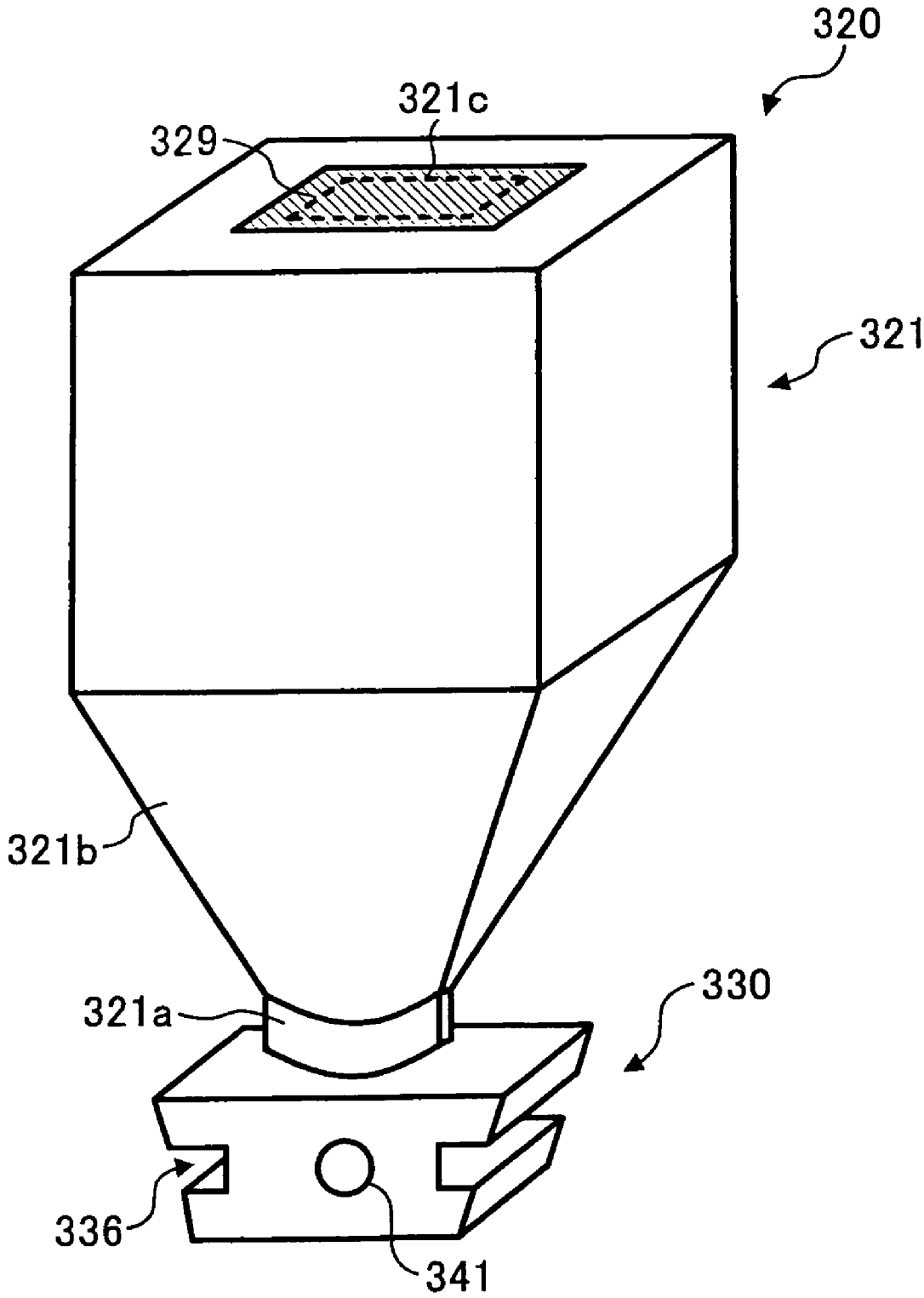
FIG. 21 is a perspective view of a bottle-shaped developer container used in the developer conveying mechanism of FIG. 4.
Figure 22:
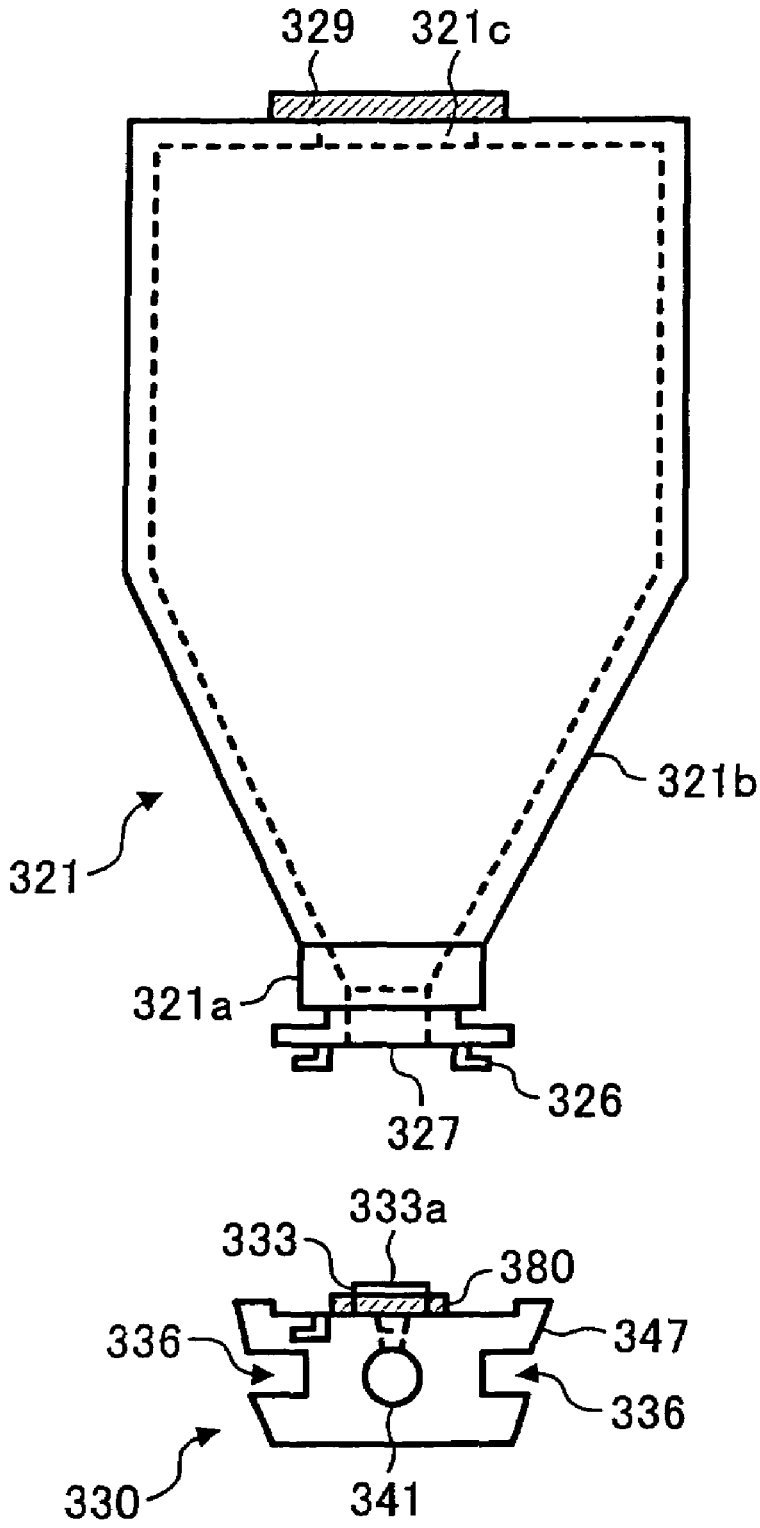
FIG. 22 is a front view of the developer container of FIG. 21.

Referring to FIGS. 21 and 22, a structure of another developer container 320 according to a second exemplary embodiment is described.

FIG. 21 shows a perspective view of the developer container 320 according to the second embodiment of the present invention. FIG. 22 shows a front view of a developer container 320 of FIG. 21, with a developer case 321 and a cap 330 separated from each other.

The structure of the developer container 320 is basically same as the structure of the developer container 20 described in the first embodiment, except that the developer container 320 includes a bottle-shaped developer case 321 (hereinafter, referred to as a "bottle") while the developer container 20 includes the bag-like developer case 21 having the developer bag 22 and the adaptor 25 in combination.

As shown in FIGS. 21 and 22, the developer container 320 of the second embodiment mainly includes the bottle 321, the cap 330, and a filter 329.

The bottle 321 includes a resin material such as polyethylene, polycarbonate, and/or nylon, and is blown-molded to have an average thickness of the resin material from approximately 1 mm to approximately 2 mm.

The bottle 321 includes, like the developer case 21 of the first embodiment, an opening 321*a* for discharging developer contained in the bottle 321. The opening 321*a* has an engaging member 326 and a developer outlet 327. The engaging member 326 engages with a guide member 347 of the cap 330. The developer outlet 327 communicates with a tapered inlet bore 333*a* of the cap 330.

The engaging member 326 and the developer outlet 327 are integrally mounted on the opening 321*a*. A nozzle-receiving hole 327 of the bottle 321 is received the funnel 333 of the cap 330.

The cap 330 includes a funnel 333, a tapered inlet bore 333*a*, grooves 336, a nozzle-receiving hole 341, the guide member 347, and a sponge seal 380. The cap 330 is basically similar to the cap 30, except for the sponge seal 380.

The sponge seal 380 is a sealing member including foamed polyurethane.

While the cap 30 has the O-ring 43 around the circumference of the funnel 33, the cap 330 has the sponge seal 380 as a sealing member around the circumference of a funnel 333 of the cap 330. With the sponge seal 380 attached, a portion of the cap 330 and the developer outlet 327 are engaged in close proximity.

The bottle 321 further includes an air inlet 321*c* on a surface opposite to the opening 321*a*. The air inlet 321*c* is a hole provided to introduce air into the bottle and is covered with the filter 329. The filter 329 adheres to the air inlet 321*c* and serves as a developer filter transmitting air to collect developer. With the above-described structure, the bottle 321 can restrain inner pressure variation of the developer caused by suction by the pump unit 60 of FIG. 4, and prevent scatter of the developer to the outside of the developer container 320.

The bottle 321 further includes a hopper 321*b* that is inclined downward toward the opening 321*a*. That is, as shown in FIG. 22, the bottle 321 has a tapered portion in a vicinity of the opening 321*a*. Therefore, when the developer container 320 is attached to the color laser printer 1, with the opening 321*a* facing downward, developer contained in the bottle 321 is effectively conveyed toward the cap 330. More specifically, even developer stored in a vicinity of an inner surface of the bottle 321 can smoothly slide down along a tapered surface of the hopper 321*b* toward the opening 321*a* of the bottle 321. Therefore, the developer close to the inner surface of the bottle 321 can be smoothly conveyed and may not remain in the bottle 321.

Similar to the developer container 20 of the first embodiment, the developer container 320 is assembled such that the bottle 321 packed with developer may be engaged with the developer outlet 327 of the cap 330. The developer container 320 is mounted to the mount portion 100 of the color laser printer 1. The developer contained in the developer container 320 is conveyed to the developing unit 14 via the nozzle 110 connecting to the cap 330.

As described above, in a similar manner as the first embodiment, the developer container 320 of the second embodiment is configured to have the developer outlet 327 of the bottle 321 run perpendicular to the nozzle-receiving hole 341 of the cap 330 to which the nozzle 110 is engaged.

With the above-described structure, the developer container 320 may be flexibly disposed without limiting a size of an image forming apparatus and the developer container 320 itself. That is, the developer container 320 may provide flexibility to layouts of the color laser printer 1 including the developer container 320.

As previously described, the cap 330 of this embodiment has the sealing member including foamed polyurethane. The material of the sealing member is not limited to the foamed polyurethane, but may include a packing such as an O-ring, as the first embodiment, to hermetically attach the cap 330 and the bottle 321.

The second embodiment includes the sealing member disposed at the cap 330, but the present invention is not limited only to such sealing member. For example, an embodiment of the present invention can provide a sealing member to be attached at an inside diameter of the nozzle-receiving hole 327. Further, another embodiment of the present invention can provide a sealing member to be disposed at both the cap 330 and the inside diameter of the nozzle-receiving hole 327. These sealing members can include a foamed polyurethane.

A sealing member including a resin such as a foamed polyurethane has a lower sealing ability than a packing such as an O-ring. When the sponge seal 380 including a foamed polyurethane is used to seal an engaging portion between the cap 330 and the nozzle-receiving hole 327 of the bottle 321, the engaging portion can introduce a certain amount of air. Therefore, even when the bottle 321 does not include the air inlet 321*c* and the filter 329, variations of the inner pressure of the bottle 321 may be controlled.

This embodiment includes bottle 321 and the cap 330 as separate parts integrally adhered by welding or other adhering methods. However, a configuration of the bottle 321 and the cap 330 is not limited only to that described above. For example, an embodiment of the present invention can use a configuration of the bottle 321 and the cap 330 formed as a single member including a single material. This can bring production costs down.

The above-described embodiments include a developer container that uses one-component developer, that is, a developer container containing toner only. However, the present invention is not limited only to such developer container. For example, an embodiment of the present invention can be a developer container using two-component developer, that is, a developer container containing toner and carriers. With this developer container, the developer containers 20 and 320 may be flexibly disposed without limiting a size of an image forming apparatus and the developer containers 20 and 320 themselves. That is, the developer containers 20 and 320 may provide flexibility to layouts of the color laser printer 1 including the developer containers 20 and 320.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

The invention claimed is:

1. A developer container, comprising:

a cap configured to control a flow of developer, said cap comprising a hole configured to be detachably engaged with a nozzle connecting to an image forming apparatus;

a developer case configured to contain the developer, said case comprising an outlet configured to be connected to the hole; and a bag including a flexibly foldable material and having at least one sheet member attached on a surface thereof, said bag configured to decrease in volume when an inner pressure thereof decreases, the at least one sheet member having a laterally bow-shaped surface extending outwardly from the surface of the bag and configured to reinforce the surface of the bag.

2. The developer container according to claim 1, wherein the at least one sheet member is attached to the surface such that a center portion of the at least one sheet member extends outwardly from the surface of the bag more than an edge portion of the at least one sheet member.

3. The developer container according to claim 1, wherein the bag has first surfaces with a fold and second surfaces without a fold, the second surfaces disposed facing each other; and the at least one sheet member is adhered to one of the second surfaces.

4. The developer container according to claim 3, wherein the at least one sheet member comprises a gripper.

5. The developer container according to claim 4, wherein the gripper includes a plurality of through holes formed in the at least one sheet member.

6. The developer container according to claim 5, wherein the plurality of through holes formed in the sheet member are arranged to form an arc.

7. The developer container according to claim 6, wherein the plurality of through holes have at least one rounded corner on a surface of the sheet member opposite to the surface of the developer container.

8. The developer container according to claim 1, wherein the developer case contains toner.

9. The developer container according to claim 8, wherein the developer case further contains a carrier.

10. The developer container according to claim 1, wherein the developer case further comprises:

an adaptor adhered to the opening of the bag and having a portion engaging with the outlet of the developer case and configured to connect the developer case and the cap.

11. The developer container according to claim 10, wherein the cap is detachably attached to the outlet of the adaptor.

12. The developer container according to claim 11, further comprising:

a sealing member configured to hermetically seal a portion between the cap and the outlet of the adaptor.

13. The developer container according to claim 12, wherein the sealing member includes a packing disposed at a funnel portion of the cap.

14. The developer container according to claim 13, wherein the packing includes an O-ring.

15. The developer container according to claim 10, wherein the developer case contains toner.

16. The developer container according to claim 15, wherein the developer case further contains a carrier.

17. The developer container according to claim 10, wherein the adaptor and the cap are formed as a single developer conveying member.

18. The developer container according to claim 17, wherein the developer case contains toner.

19. The developer container according to claim 18, wherein the developer case further contains a carrier.

20. The developer container according to claim 1, wherein the developer case comprises:

a bottle having a portion engaged with the outlet of the developer case.

21. The developer container according to claim 20, wherein the bottle comprises an air inlet arranged at a portion different from a portion to which the outlet is engaged and comprising a filter configured to prevent developer from passing through the air inlet.

22. The developer container according to claim 20, wherein the bottle comprises a tapered portion in which a lateral cross sectional area thereof decreases toward the outlet.

23. The developer container according to claim 20, wherein the cap is detachably attached to the outlet of the bottle.

24. The developer container according to claim 23, further comprising:

a sealing member configured to hermetically seal a portion between the cap and the outlet of the bottle.

25. The developer container according to claim 24, wherein the sealing member includes a packing disposed at a funnel portion of the cap.

26. The developer container according to claim 25, wherein the packing includes an O-ring.

27. The developer container according to claim 26, wherein the sealing member is disposed at a portion of at least one of the cap and the outlet of the bottle.

28. The developer container according to claim 27, wherein the sealing member includes a foamed polyurethane.

29. The developer container according to claim 28, wherein the bottle and the cap are formed as a single developer conveying member.

30. The developer container according to claim 20, wherein the developer case contains toner.

31. The developer container according to claim 30, wherein the developer case further contains a carrier.

32. The developer container according to claim 1, wherein the developer case allows the developer to flow through the outlet in a direction perpendicular to a direction of flow of developer through the hole.

33. The developer container according to claim 32, wherein the developer case contains toner.

34. The developer container according to claim 33, wherein the developer case further contains a carrier.

35. A developer container, comprising:

means for controlling a flow of developer, said means for controlling including means for engaging with a nozzle connected to an image forming apparatus; and means for containing the developer, said means for containing including means for communicating with the means for engaging; and a bag including a flexibly foldable material and having means for reinforcing attached on a surface thereof, said bag configured to decrease in volume when an inner pressure thereof decreases, the means for reinforcing having a laterally bow-shaped surface extending outwardly from the surface of the bag and for reinforcing the surface of the bag.

36. The developer container according to claim 35, wherein the means for reinforcing is attached to the surface such that a center portion of the at least one sheet member extends outwardly from the surface of the bag more than an edge portion of the at least one sheet member.

37. The developer container according to claim 35, wherein the bag has first surfaces with a fold and second surfaces without a fold, the second surfaces disposed facing each other; and the means for reinforcing is adhered to one of the second surfaces.

38. The developer container according to claim 37, wherein the means for reinforcing comprises a gripper including a plurality of through holes formed in the means for reinforcing.

39. The developer container according to claim 35, wherein the means for containing further comprises:

means for connecting engaged with the means for communicating and for connecting the means for controlling and the means for containing.

40. The developer container according to claim 39, wherein the means for controlling is detachably attached to the means for communicating.

41. The developer container according to claim 40, further comprising:

means for sealing a portion between the means for controlling and the means for communicating.

42. The developer container according to claim 41, wherein the means for sealing includes a packing disposed at the means for controlling.

43. The developer container according to claim 39, wherein the means for connecting and the means for controlling are formed as means for conveying developer.

44. The developer container according to claim 35, wherein the means for containing comprise:

a bottle having a portion engaged with the means for communicating.

45. The developer container according to claim 44, wherein the bottle comprises means for introducing air arranged at a portion different from a portion to which the means for communicating is engaged and comprising means for preventing developer from passing through the means for introducing.

46. The developer container according to claim 44, wherein the bottle comprises a tapered portion in which a lateral cross sectional area thereof decreases toward the means for communicating.

47. The developer container according to claim 44, wherein the means for controlling is detachably attached to the means for communicating.

48. The developer container according to claim 47, further comprising:

means for sealing a portion between the means for controlling and the means for communicating.

49. The developer container according to claim 48, wherein the means for sealing includes a packing.

50. The developer container according to claim 35, wherein the means for containing and the means for controlling are formed as means for conveying developer.

51. The developer container according to claim 35, wherein the means for containing allows the developer to flow through the means for communicating in a direction perpendicular to a direction of flow of developer through the means for engaging.

52. The developer container according to claim 35, wherein the means for containing contains toner.

53. The developer container according to claim 52, wherein the means for containing further contains a carrier.

54. An image forming apparatus, comprising:

a developing unit configured to develop a toner image;

a developer container, comprising:

a cap configured to control a flow of developer, said cap comprising a hole configured to be detachably engaged with a nozzle connected to the image forming apparatus; and a developer case configured to contain the developer, said case comprising an outlet configured to be connected to the hole; and a bag including a flexibly foldable material and having at least one sheet material attached on a surface thereof, said bag configured to decrease in volume when an inner pressure thereof decreases, the at least one sheet material having a laterally bow-shaped surface extending outwardly from the surface of the bag and configured to reinforce the surface of the bag.

55. The image forming apparatus according to claim 54, wherein the at least one sheet material is attached to the surface such that a center portion of the at least one sheet member extends outwardly from the surface of the bag more than an edge portion of the at least one sheet member.

56. The image forming apparatus according to claim 54, the developer case further comprises:

an adaptor adhering to the opening of the bag and having a portion engaging with the outlet of the developer case and configured to connect the developer case and the cap.

57. The image forming apparatus according to claim 54, wherein the developer case comprises:

a bottle having a portion engaging with the outlet of the developer case.

* * * * *